US012778301B2

(12) United States Patent
Doyon

(10) Patent No.: US 12,778,301 B2
(45) Date of Patent: Nov. 3, 2026

(54) PIVOT STRUCTURE FOR PIVOTING SEAT

(71) Applicant: SIÈGES DUCHARME INTERNATIONAL (1991) INC., Montreal (CA)

(72) Inventor: Jean-Christophe Doyon, Terrebonne (CA)

( * ) Notice: Subject to any disclaimer, the term of this patent is extended or adjusted under 35 U.S.C. 154(b) by 240 days.

(21) Appl. No.: 18/624,345

(22) Filed: Apr. 2, 2024

(65) Prior Publication Data

US 2024/0335040 A1 Oct. 10, 2024

Related U.S. Application Data

(60) Provisional application No. 63/456,881, filed on Apr. 4, 2023.

(51) Int. Cl.
*A47C 1/121* (2006.01)
*A47C 7/56* (2006.01)

(52) U.S. Cl.
CPC ..... *A47C 1/121* (2013.01); *A47C 7/56* (2013.01)

(58) Field of Classification Search
CPC ..... A47C 1/121; A47C 7/56
See application file for complete search history.

(56) References Cited

U.S. PATENT DOCUMENTS

| | | | | |
|---|---|---|---|---|
| 3,705,744 | A | 12/1972 | Piretti et al. | |
| 5,524,966 | A | 6/1996 | Piretti | |
| 6,056,354 | A | 5/2000 | Tseng | |
| 6,305,742 | B1 | 10/2001 | Spendlove et al. | |
| 6,481,789 | B1 | 11/2002 | Ambasz | |
| 7,021,705 | B1 | 4/2006 | Niermeyer et al. | |
| 7,938,485 | B1 | 5/2011 | Perciballi et al. | |
| 9,295,334 | B2 * | 3/2016 | Olarte | A47C 7/58 |
| 10,064,491 | B2 | 9/2018 | Piretti | |
| 2003/0090136 | A1 * | 5/2003 | Olarte | A47C 1/121 297/335 |
| 2004/0056522 | A1 | 3/2004 | Bailey, Jr. | |
| 2004/0100134 | A1 | 5/2004 | Plant et al. | |
| 2008/0238157 | A1 | 10/2008 | Wright et al. | |
| 2008/0284216 | A1 | 11/2008 | Mayercheck | |

(Continued)

FOREIGN PATENT DOCUMENTS

| | | |
|---|---|---|
| EP | 3095354 | 11/2016 |
| IT | 20090187 | 1/2011 |

*Primary Examiner* — David R Dunn
*Assistant Examiner* — Tania Abraham
(74) *Attorney, Agent, or Firm* — Decode Legal Inc.; Mathieu Audet

(57) ABSTRACT

A chair includes a support structure mounted to the side chair structure, the support structure comprising a side wall having an upward facing opening and a bottom edge, an abutting components up front and rear to the opening, and a pivoting assembly mounted to the seat. The pivoting assembly comprises a link arm extending away from the seat and a cam component mounted to the link arm distant to the seat. When the seat is mounted to the support structure, the arm link sits on the bottom edge of the opening. The cam component is free to travel between a) a first position in which the cam component butts up against the first abutting component and the seat is in a seating position and b) a second position wherein the cam component butts up against the second abutting component and the seat is in an upright position.

18 Claims, 17 Drawing Sheets

(56) References Cited

U.S. PATENT DOCUMENTS

| | | | |
|---|---|---|---|
| 2010/0156156 | A1 | 6/2010 | Smith |
| 2019/0021502 | A1 | 1/2019 | Piretti |
| 2019/0254431 | A1 | 8/2019 | Borras Pons |

* cited by examiner

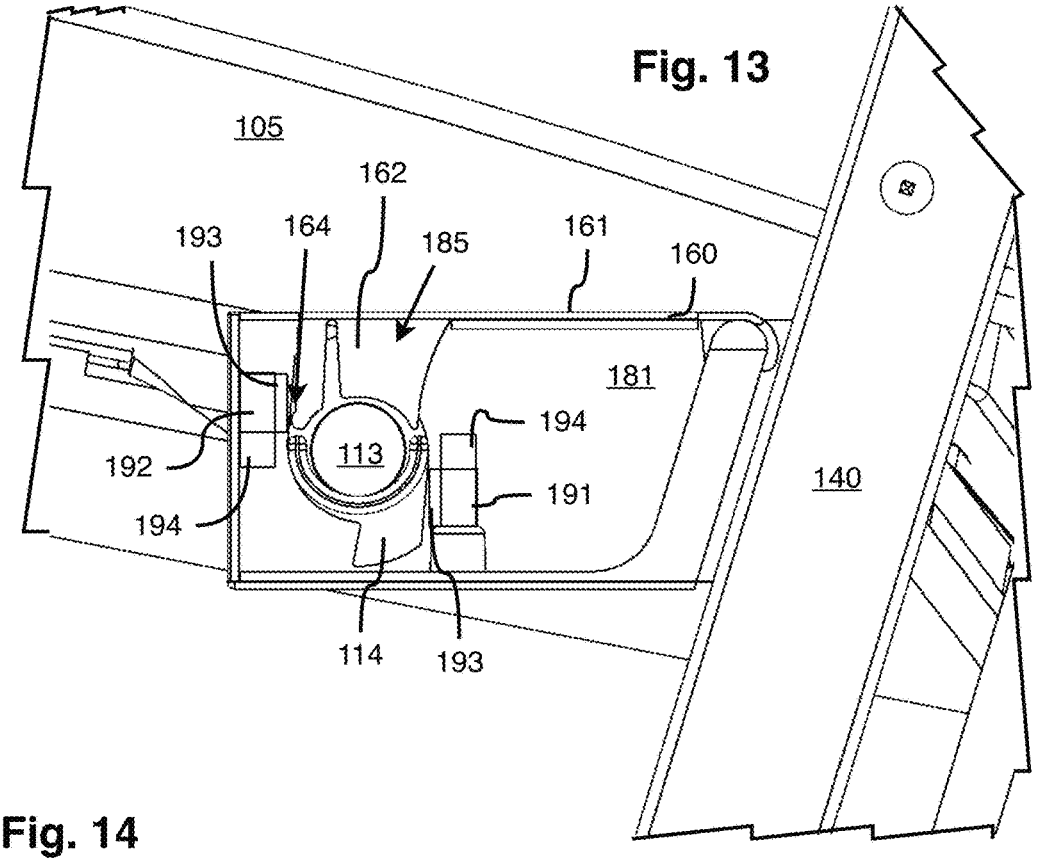
Fig. 13
Fig. 14
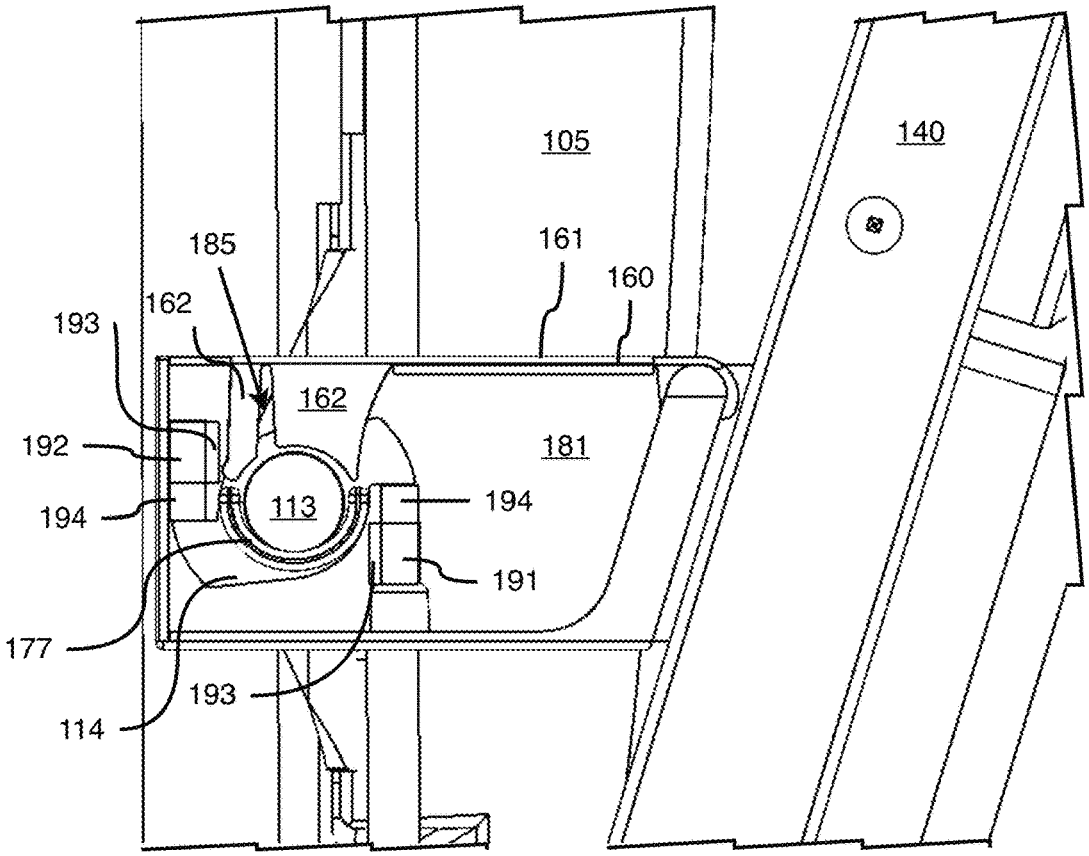

PIVOT STRUCTURE FOR PIVOTING SEAT

CROSS-REFERENCE TO RELATED APPLICATION

This application relates to and is a non-provisional application claiming priority under 35 U.S.C. § 119(e) from provisional patent application filed in the United States, Ser. No. 63/456,881, filed Apr. 4, 2023, under 35 U.S.C. § 111, entitled PIVOT STRUCTURE FOR PIVOTING SEAT, the specification of which is hereby incorporated herein by reference in its entirety.

BACKGROUND

(a) Field

The subject matter disclosed generally relates to devices for pivoting seats. More particularly, the subject matter disclosed relates to structures allowing installation, removal, maintenance and pivoting of pivoting seats between a seating position and an upright position.

(b) Related Prior Art

In existing pivoting seats, the system allowing the seat to pivot is often complex and difficult to put in place. Indeed, these systems are composed of many parts and are not adaptable enough.

Furthermore, most of the pivoting systems allowing seats to pivot feature other drawbacks such difficulty for maintenance, sensibility to misalignment, rough ends of courses, lack of robustness, lack of solutions to automatically bias the seat into the upright position, etc.

There is therefore a need for improved systems to adapt to the seats and allow the seat of a chair to pivot between a seating position and an upright position.

SUMMARY

In some aspects, the description herein relates to an assembly for mounting a seat to a chair structure, the assembly including: support arms for mounting the seat thereto, each one of the support arms including a cap movable between an opened position and a closing position for selectively closing the support arm into an enclosure; a pair of pivoting assemblies mounted to the seat and extending along a pivot axis on opposite sides of the seat, each one of the pivoting assemblies including a) a link arm, and b) a cam component coupled to the link arm distant from the seat, wherein the cam component is adapted to rotate around the pivot axis along with the seat, with the cam component having its rotation being limited in both directions by abutting against at least one end-of-course surface, an preferred embodiment including a pair of end-of-course surfaces wherein, when the caps are in the opened position, each one of the support arms features a path for inserting the cam component into the enclosure, and wherein, when the caps are in the closing position, the cam components are locked into the enclosure with the link arms extending between the seat and the enclosure.

In some aspects, the description herein relates to an assembly, wherein the cam component includes a first pair of abutting faces extending tangentially to a first circle of a first diameter centered on the pivot axis, and a second pair of abutting faces extending tangentially to a second circle of a second diameter centered on the pivot axis, wherein the first diameter is smaller than the second diameter.

In some aspects, the description herein relates to an assembly, wherein the cam component includes a wing including a) a first abutting face substantially tangent to a first circle centered on the pivot axis, with the first abutting face being perpendicular to a first radius line; and b) a second abutting face substantially tangent to a second circle centered on the pivot axis, with the second abutting face being perpendicular to a second radius line, wherein an angle smaller than 90 degrees spans between the first radius line and the second radius line.

In some aspects, the description herein relates to an assembly, wherein the assembly features a ratio of a diameter of the first circle over the diameter of the second circle of at least 1.5 over 1.

In some aspects, the description herein relates to an assembly, wherein the assembly features a spanning angle between a first radius line perpendicular to the first abutting face and a second radius line perpendicular to the second abutting face of less than 90 degrees, wherein the first radius line and the second radius line extend from the pivot axis.

In some aspects, the description herein relates to an assembly, wherein the end-of-courses surfaces are located in the enclosure distant from the cap.

In some aspects, the description herein relates to an assembly, wherein the first circle has a first diameter smaller than the link arm where coupled to the cam component.

In some aspects, the description herein relates to an assembly, wherein the second circle has a first diameter greater than the link arm where coupled to the cam component.

In some aspects, the description herein relates to an assembly, wherein the cam component provides flat abutting faces, and wherein the end-of-course surfaces are flat, and wherein the abutting faces are designed to abut over a substantial portion of its surface against the end-of-course surfaces.

In some aspects, the description herein relates to an assembly, further including blocks having two faces directed orthogonally from each other, each of the two faces providing an end-of-course surface.

In some aspects, the description herein relates to an assembly, wherein the blocks include compressible material able to damper movement of the cam component when abutting the block.

In some aspects, the description herein relates to an assembly, wherein the blocks being designed to be abutted about simultaneously by abutting faces of the cam component located on opposed wings, the blocks providing distributed couple over the cam component.

In some aspects, the description herein relates to an assembly, wherein the support arms includes a trim removably mounted to a side plate part of the support arm.

In some aspects, the description herein relates to an assembly, wherein the support arm further includes a side plate featuring a recess designed for a lug located in the cap to be inserted in the recess to lock the cap into the closing position.

In some aspects, the description herein relates to an assembly, wherein the support arm further includes a pair of side plates, wherein the enclosure is designed to simultaneously receive a first cam component of the seat and a second cam assembly of another seat each coupled to respective link arm, with the respective link arms extending in opposed direction between a) the enclosure and the seat, and b) the enclosure and the other seat.

In some aspects, the description herein relates to an assembly, wherein the block includes a first face designed for the cam component to abut against, and a second face opposed to the first face, wherein clearance of a length at least equivalent to space between the first face and the second face is present aside the second face.

In some aspects, the description herein relates to an assembly, wherein the cam component includes a pair of abutting faces extending parallel to each other parallel and equidistant to a plane coplanar with the pivot axis.

In some aspects, the description herein relates to an assembly, wherein the cam component is non-rotatably secured to the link arm.

In some aspects, the description herein relates to a chair including a chair structure including a pair of enclosures, a seat and an assembly for mounting the seat to the chair structure, the assembly including: support arms for mounting the seat thereto, each one of the support arms including a cap movable between an opened position and a closing position for selectively closing the support arm into one of the enclosures; a pair of pivoting assemblies mounted to the seat and extending along a pivot axis on opposite sides of the seat, each one of the pivoting assemblies including a) a link arm, and b) a cam component coupled to the link arm distant from the seat, wherein the cam component is adapted to rotate around the pivot axis along with the seat, with the cam component having its rotation being limited in both directions by abutting against end-of-course surfaces, wherein, when the caps are in the opened position, each one of the support arms features a path for inserting the cam component into the enclosure, and wherein, when the caps are in the closing position, the cam components are locked into the enclosure with the link arms extending between the seat and the enclosure.

In some aspects, the description herein relates to a chair, wherein the cam component includes a first pair of abutting faces extending tangentially to a first circle of a first diameter centered on the pivot axis, and a second pair of abutting faces extending tangentially to a second circle of a second diameter centered on the pivot axis, wherein the first diameter is smaller than the second diameter.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which:

FIG. 13 is a left side view of a portion of the chair of FIG. 1 with the seat in the seating position and the distal side wall removed;

FIG. 14 is a left side view of a portion of the chair of FIG. 1 with the seat in the elevated position and the distal side wall removed;

It will be noted that throughout the appended drawings, like features are identified by like reference numerals.

DETAILED DESCRIPTION

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

Figure 1:
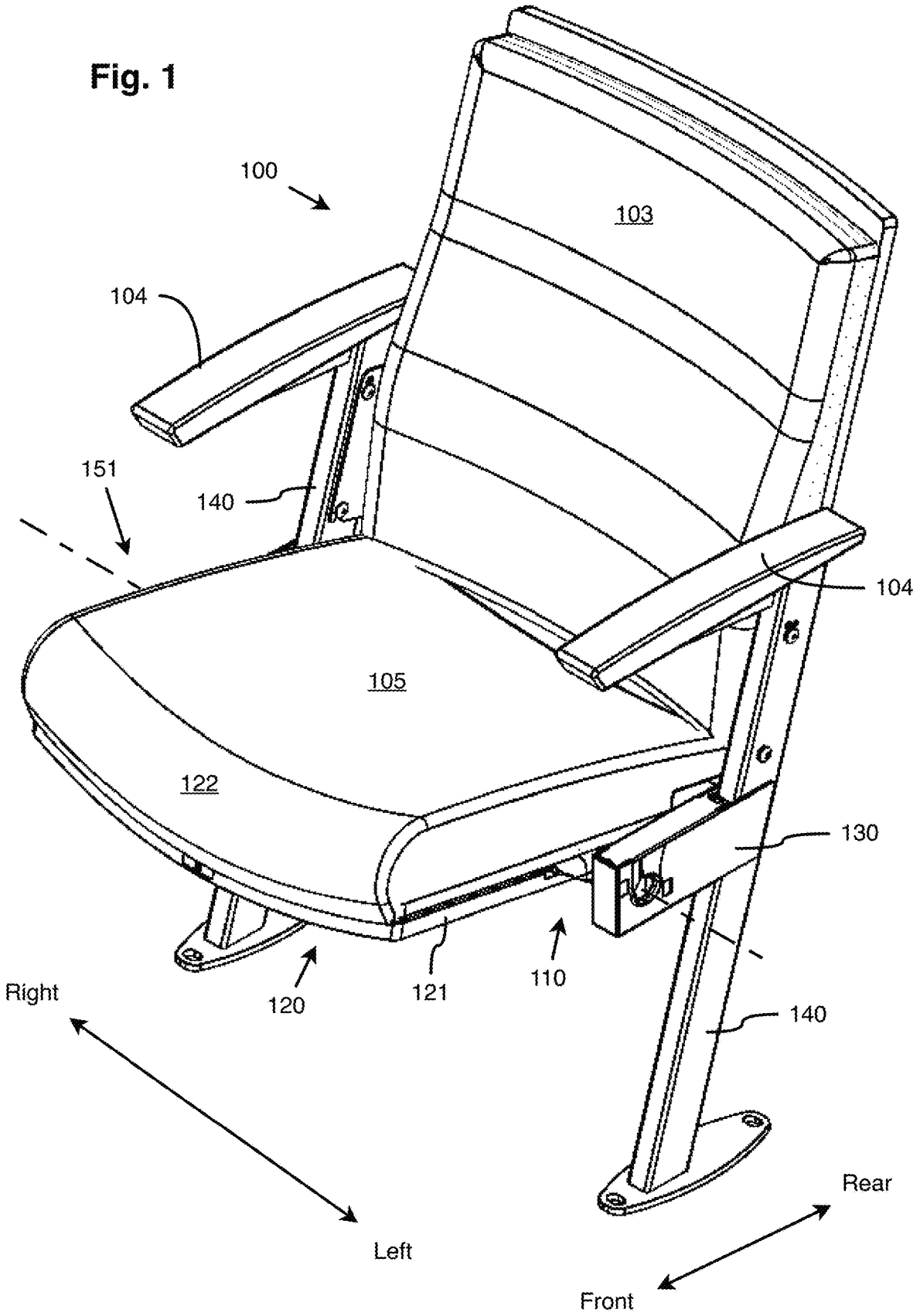
FIG. 1 is a view perspective view of a chair with the seat in a seating position and the hinged caps in the occluding position in accordance with an embodiment.
Figure 2:
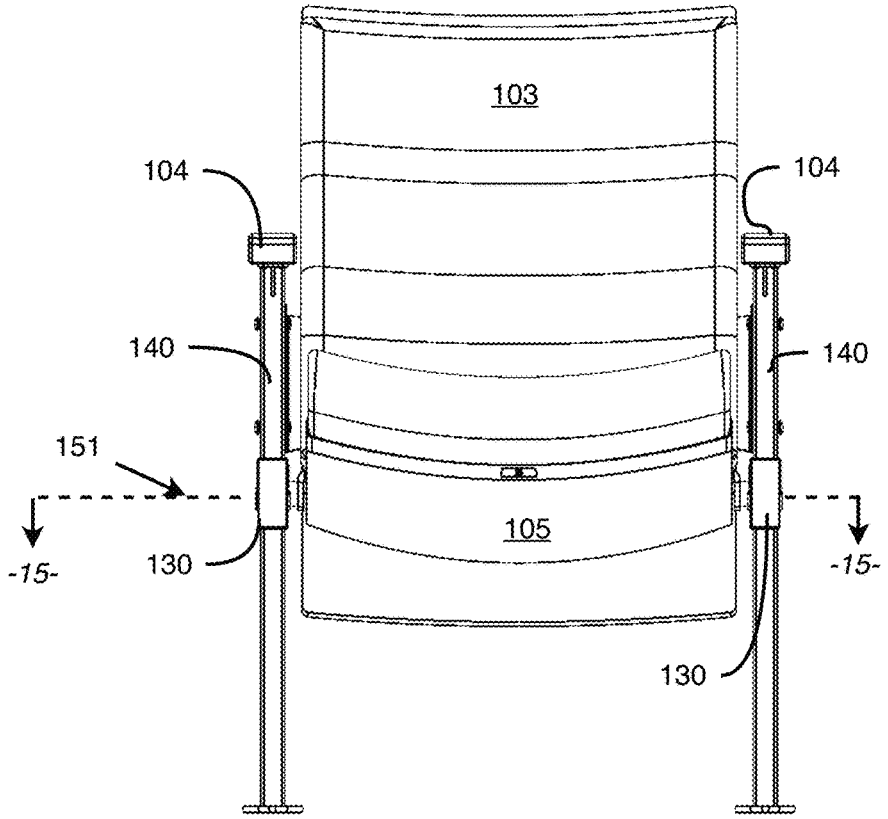
FIG. 2 is front view of the chair of FIG. 1.
Figure 3:
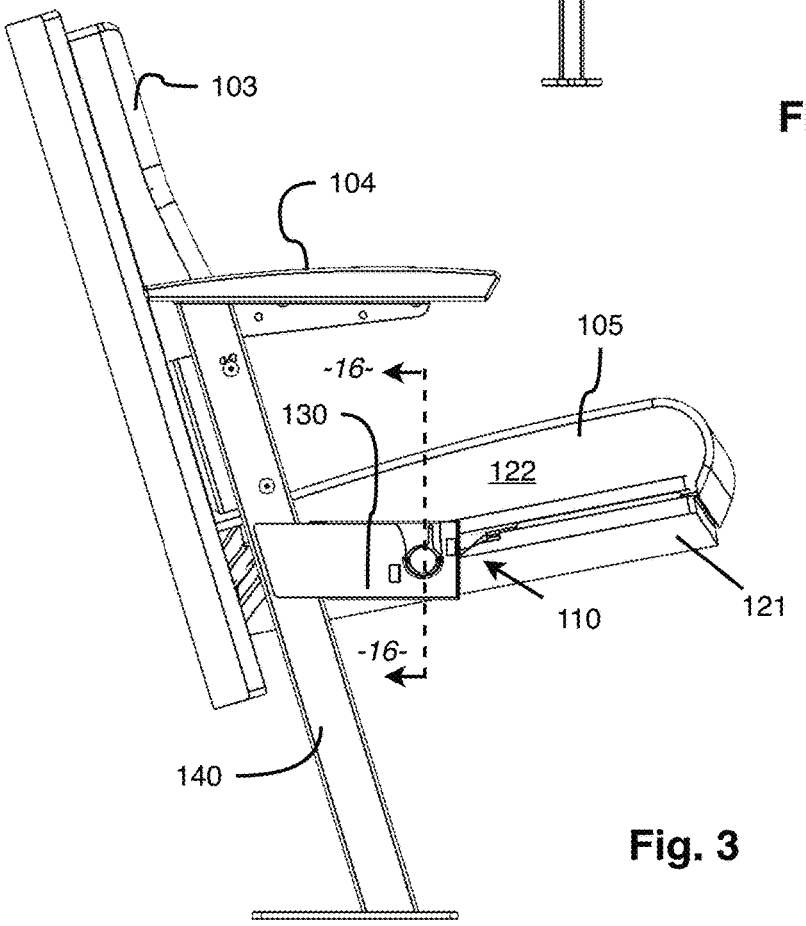
FIG. 3 is a right side view of the chair of FIG. 1.

The terms "left", "right", "front", "rear", "top", "up", "upper", "bottom", "lower", "down", "vertical", "horizontal", "interior" and "exterior" and the like are intended to be construed in their normal meaning in relation with normal usage of the device being described, with spatial references associated with the depiction of FIG. 1.

The term "floor" means a flat surface in the room where the system in installed.

Figure 4:
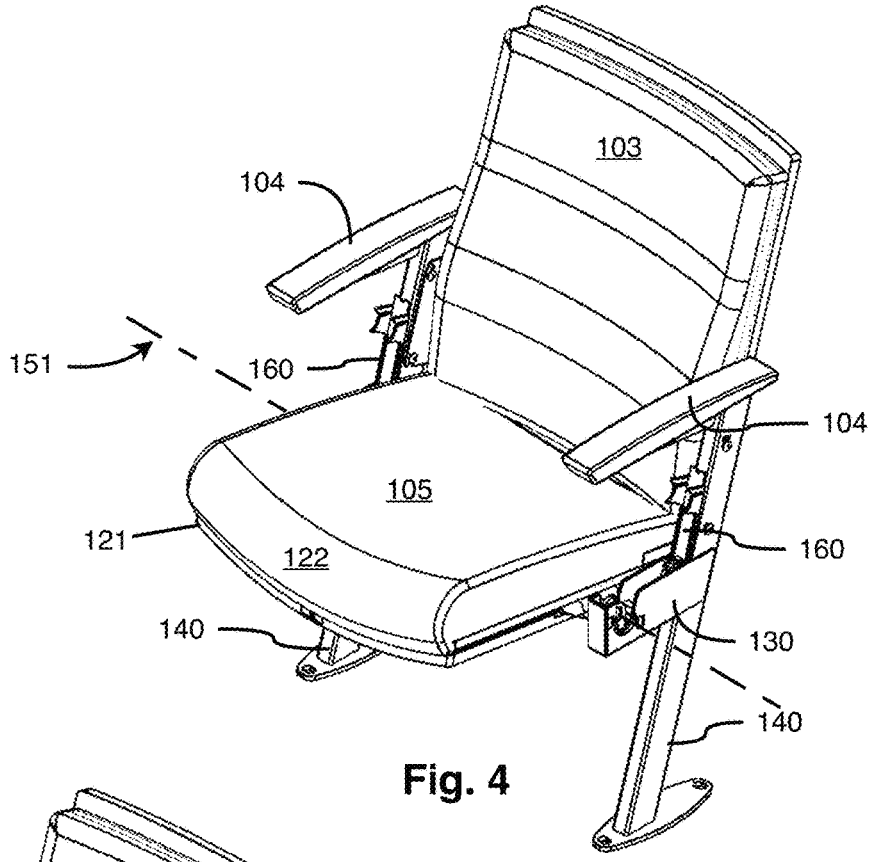
FIG. 4 is a perspective view of the chair of FIG. 1 with the hinged cap in the elevated position.
Figure 5:
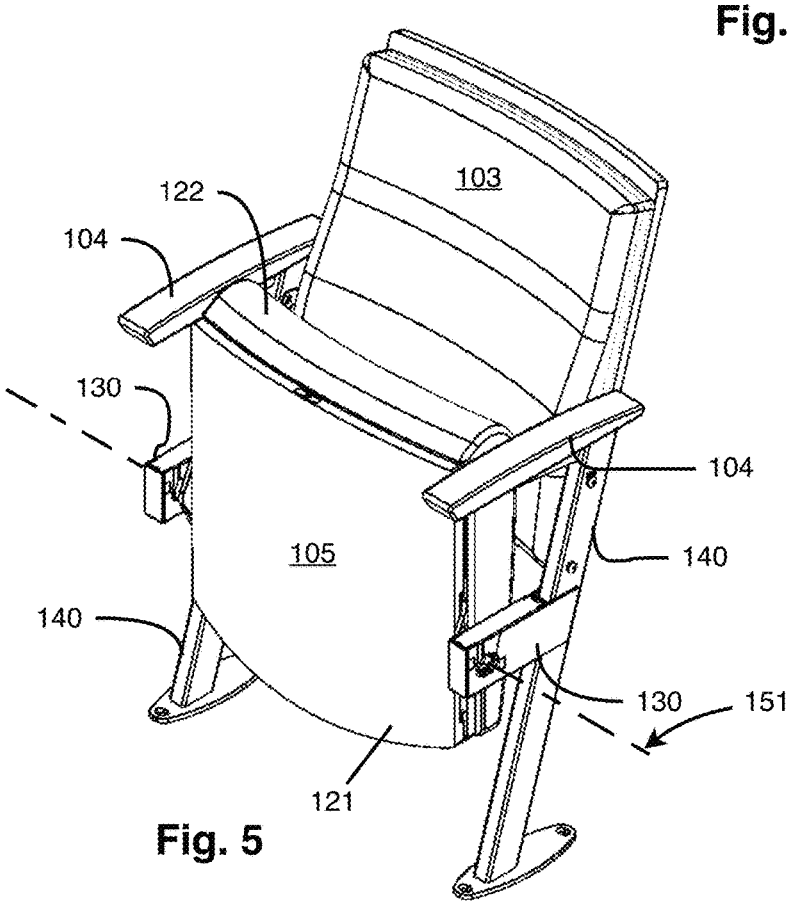
FIG. 5 is a perspective view of the chair of FIG. 1 with the seat in the upright position.
Figure 6:
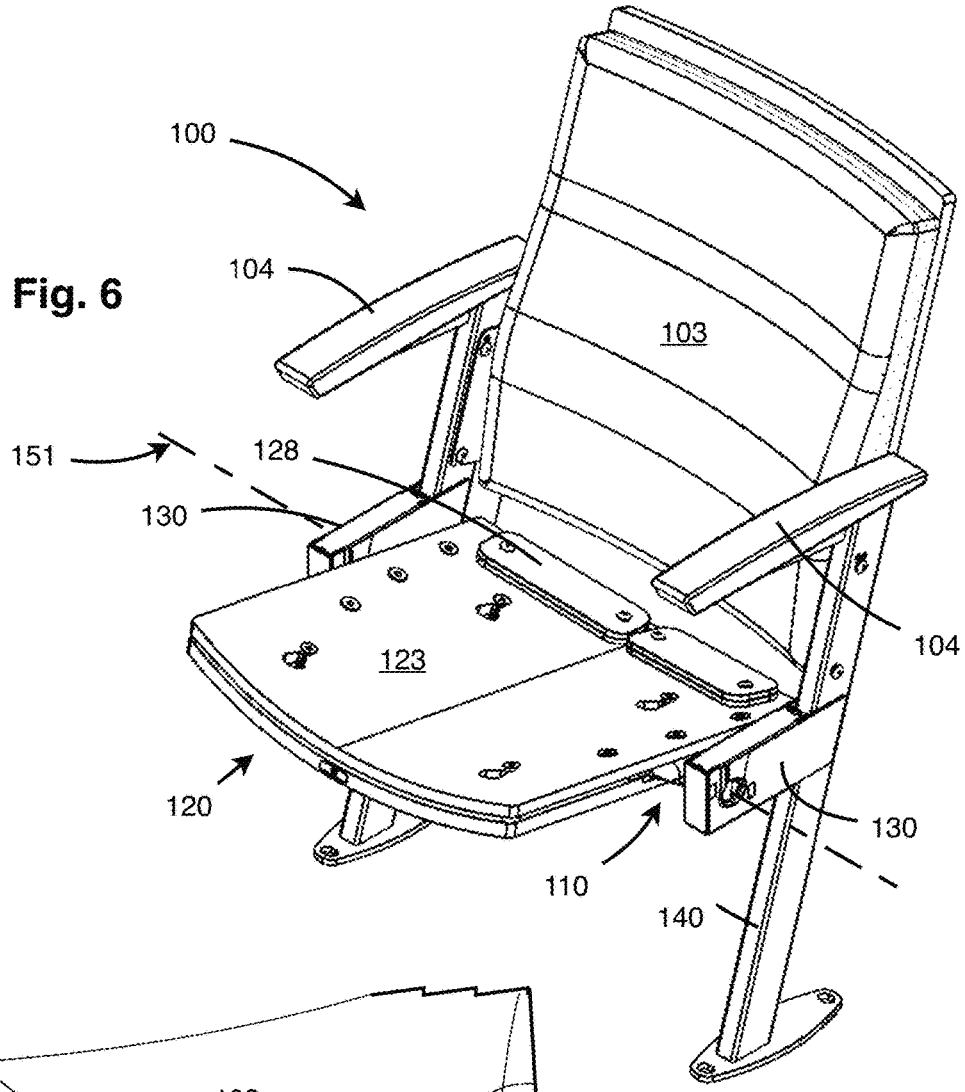
FIG. 6 is a perspective view of a portion of the chair of FIG. 1, with the cushion of the seat removed.
Figure 7:
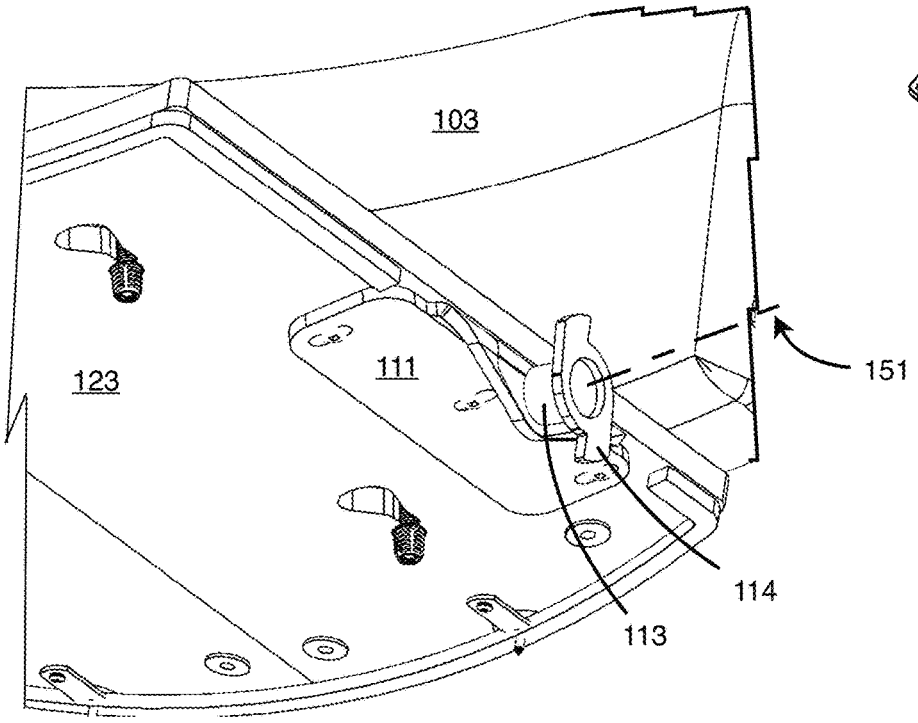
FIG. 7 is a more detailed perspective view of a portion of the chair of FIG. 1, with the cushion of the seat, the bottom seat base, and the left support structure removed.
Figure 8:
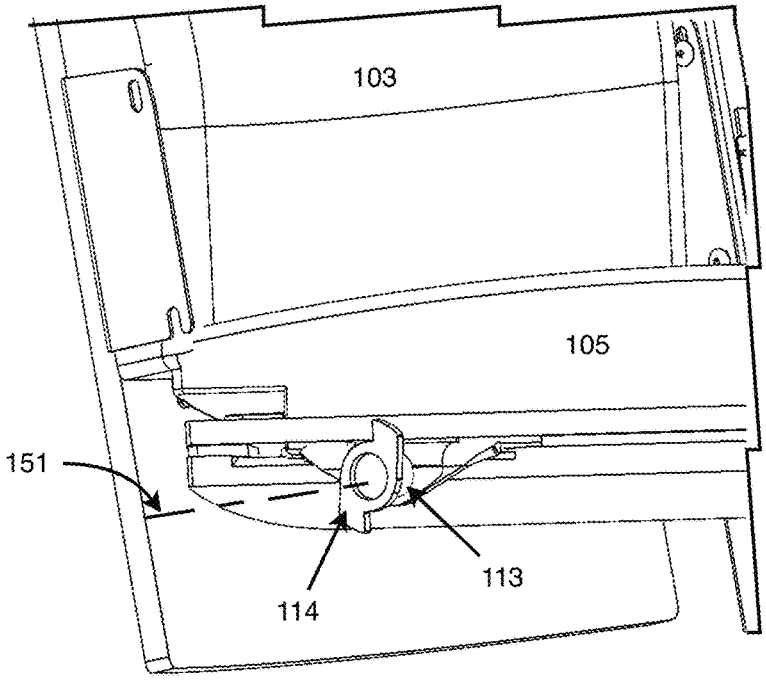
FIG. 8 is a perspective view of a portion of the chair of FIG. 1, with the right side chair structure and the right support structure removed.
Figure 9:
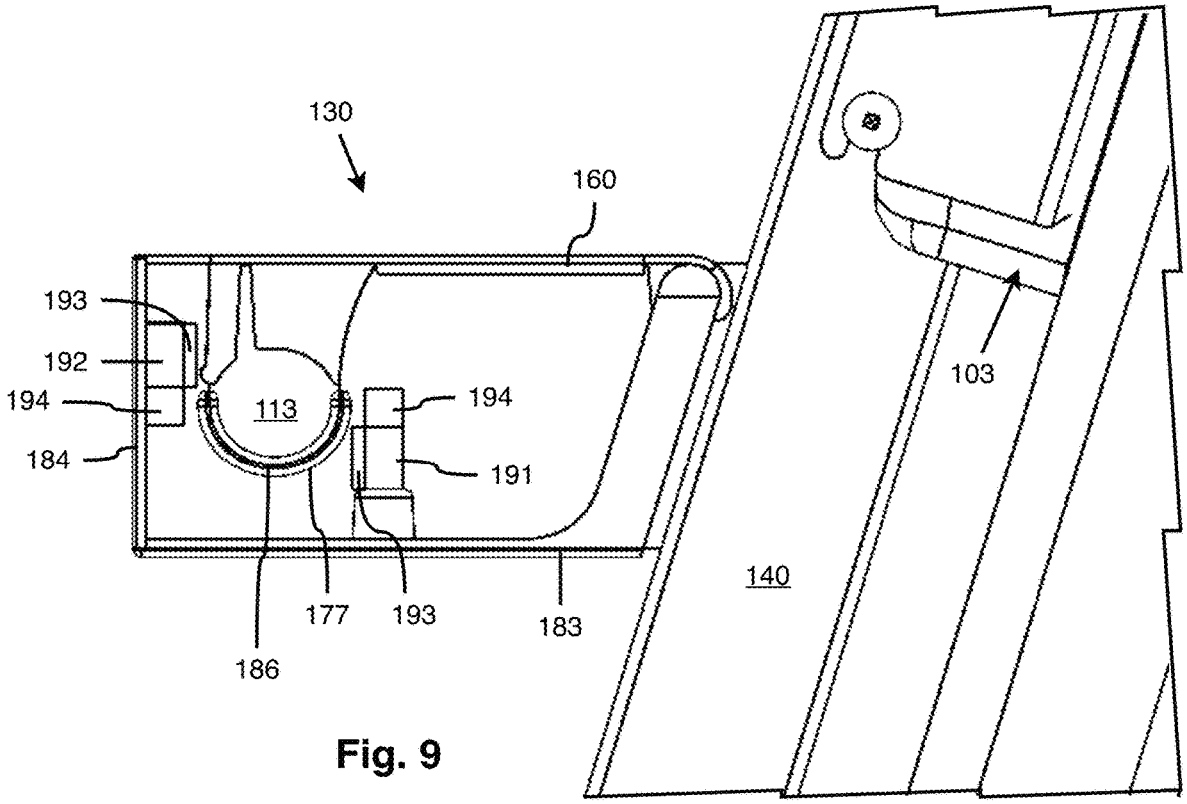
FIG. 9 is a right side view of a portion of the right side chair structure and the right support structure with the proximal side wall removed.
Figure 17:
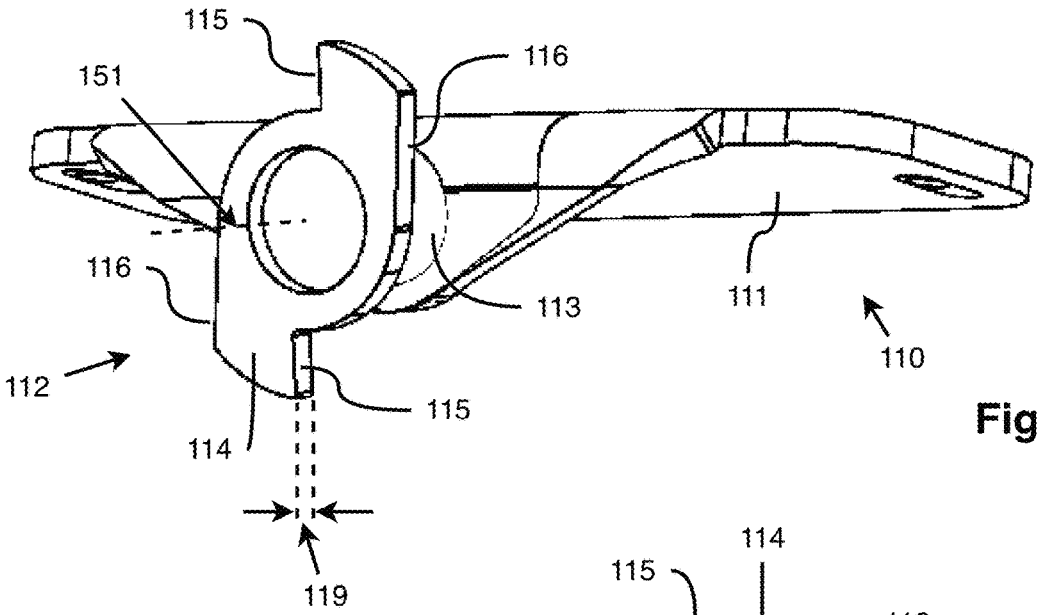
FIG. 17 is a perspective view of the right pivoting element of the chair of FIG. 1.
Figure 18:
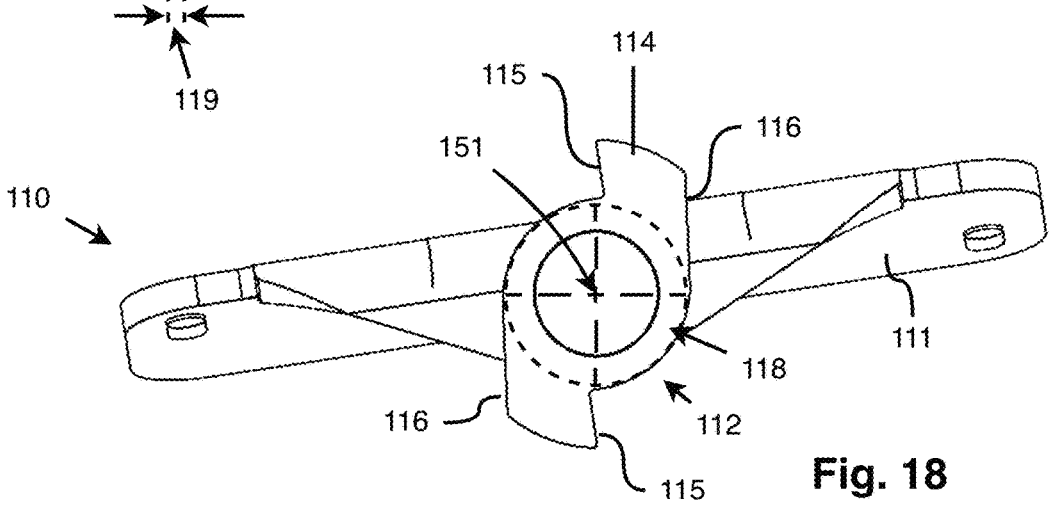
FIG. 18 a left side view of the pivoting element of FIG. 17.
Figure 19:
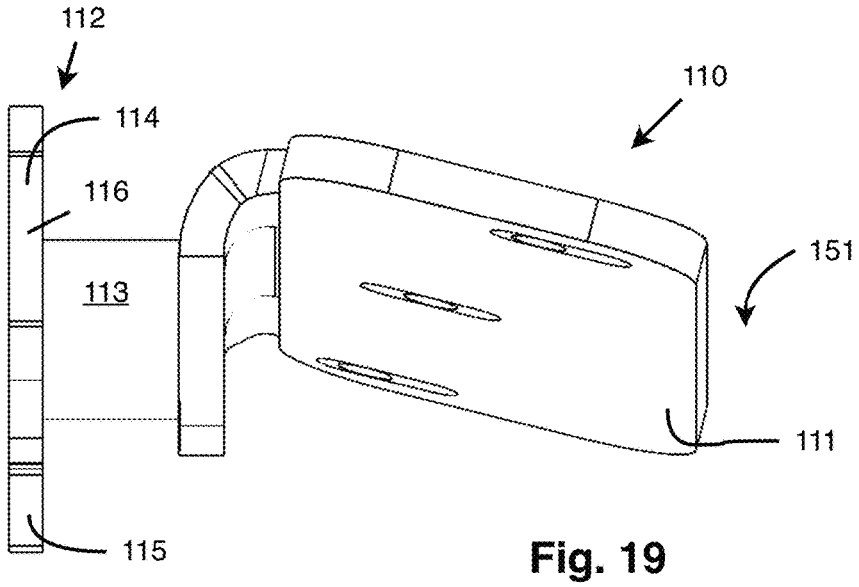
FIG. 19 is a front view of the pivoting element of FIG. 17.

Referring now to the drawings, and more particularly to FIGS. 1 to 5, a seat assembly 105 of a chair 100 is adapted to allow a seat 120 to pivot around an axis 151 between a seating position, FIG. 1, and an upright position, FIG. 5. The pivoting of the seat 120 is allowed by a pair of pivoting elements 110 (pivoting element 110 shown on FIG. 17), mounted to the seat 120, creating a pivotable linkage between the seat 120 and support arms 130. According to an embodiment, the support arms 130 extend parallel to the floor, about parallel to the lateral sides of the seat 120 and mounted to the floor through side chair structures 140.

According to embodiments, the chair 100 comprises a back seat 103 mounted to and bridging two side chair structures 140, and optional armrests 104 mounted to the side chair structures 140 above the support arms 130.

Referring additionally to FIGS. 6 to 8, and 17 to 19, a seat assembly 105 comprises a seat 120 and two pivoting elements 110. Each of the pivoting elements 110 comprises a seat mount 111 mounted to the seat 120, and a mounting end 112 resting on the support arm 130 via a sliding trim 177. The pivoting elements 110 comprises a link arm 113, preferably embodied as a cylindrical shaft, that connects the seat mount 111 to the mounting end 112, with the pivoting elements 110 supporting the weight of the seat 120 and of the user sat thereon. The link arms 113 define an axis 151 around which the seat 120 can pivot.

According to a preferred embodiment, the mounting end 112 comprises a cam component 114 comprising a pair of seating blocking faces 116 and of upright blocking faces 115 interfacing with the support arms 130 respectively in the seating position and the upright position.

According to a preferred embodiment, the mounting end 112 is mounted to the seat 120 such that the center of weight of the seat assembly 105, comprising the seat 120 and the pivoting elements 110, is rearward to the pivot axis 151 when no user sits on the seat 120, biasing the seat assembly 105 to the upright position.

According to an embodiment, the seat 120 comprises a seat base assembly 121, and a cushion 122. Seat mounts 111 are mounted to the seat base assembly 121 through the top seat base 123, with the bottom seat base 124 being designed to hide securing elements. The seat mounted 111 are designed to be mounted to the top seat base 123, between the top seat base 123 and the bottom seat base 124 on each lateral side of the seat 120. On top, the cushion 122 covers the top seat base 123.

The top seat base 123 is made of a solid material such as wood, plastic, or metal, while the cushion 122 is made of e.g., foam and fabric. According to embodiments, the seat 120 may comprise other components, such as trims, reinforcements, and weights 128 (for weight distribution).

According to a preferred embodiment, the cam component 114 is non-slidably mounted to the link arm 113. Accordingly, the seat 120 moving sideways exert the same movement to the cam component 114. In consequence, the side of the cam component 114 prevents the link arm 113 to disconnect to the support arm 130.

Referring to FIGS. 9 to 12, the support arm 130 comprises a proximal side wall 181, a distal side wall 182, a bottom wall 183, and a front piece 184. According to a preferred embodiment, the support arm 130 is mounted to the side chair structure 140, either permanently for example welded, or releasable, e.g., screwed, to the side chair structure 140 such as to be able to support the weight of the seat assembly 105 and of a user sitting on the seat 120. The support arm 130 is more preferably adapted such as the proximal side wall 181 is adapted to support the weight as explained in more details hereinafter, with the other components of the support arm 130 participating or not in supporting the weight according to embodiments.

According to an embodiment, the side chair structure 140 and the support arms 130 are adapted to support the twice the weight since adapted to have a seat assembly 105 mounted on both sides of the support arm 130.

According to an embodiment, the support arm 130 consists in the proximal side wall 181 and the distal side wall 182 mounted to opposite sides of the side chair structure 140, with abutting component 191 and abutting component 192 mounted to and bridging the proximal side wall 181 to the distal side wall 182. The proximal side wall 181 comprises an upward opening 185 ending with a semi-circular edge 186 on which is mounted a sliding trim 177, typically made of nylon or Teflon™, on which rests the link arm 113 when the pivoting element 110 is mounted to the support arm 130. Each one of the abutting components 191, 192 has an upright damper 193 mounted thereto, designed to damp the end of rotation of the cam component 114 when the faces 116 butt up against the abutting components 191, 192. Each one of the abutting components 191, 192 also has a seating damper 194 mounted thereto, designed to damp the end of rotation of the cam component 114 when the faces 115 butt up against the abutting components 191, 192. The upright dampers 193 and seating dampers 194 are made of rubber, foam, or other damping material able to damp the end of rotation of the cam component 114, and accordingly of the seat 120.

It is worth noting that the present configuration allows to have the abutting components 191, 192 mounted in the enclosure formed by the bottom wall 183, the side walls 181, 182, the front piece 184, and the hinged cap 160, not on the hinged cap 160, providing a compact and robust configuration in which rotation of the seat generates no couple over the hinged cap 160.

It is worth noting that in a preferred embodiment the faces 115 operate in pair, distributing the forces symmetrically over the cam component 114. Similarly, the faces 116 also operate in pair, also distributing the forces symmetrically over the cam component 114.

It is further worth noting that the depicted configuration features substantially flat surfaces for the faces 115, the faces 116, the upright dampers 193 and the seating dampers 194, extending the force over a greater surface than on curved surfaces, and easing the process and costs of maintenance of replacements of the dampers 193, 194.

According to a preferred embodiment, the abutting components 191, 192 are located one substantially closer to the bottom edge of the side wall 181, than the axis 151 of the link arm 113, while the other substantially closer to the top edge of the side wall 181 than the axis 151 of the link arm 113. According to an embodiment, one of the pair of dampers 193 or 194 provide almost co-planar surface while the other pair of dampers 193 or 194 provide two parallel surfaces for the cam component 114 to butt up against.

It is further worth noting that the mounting of the abutting components 191, 192 to both side walls 181, 182 provides strong and resistant abutting components able to undergo substantial forces without breaking or flexing, compared to plastic casings and/or cantilevered abutting components.

Figure 20:
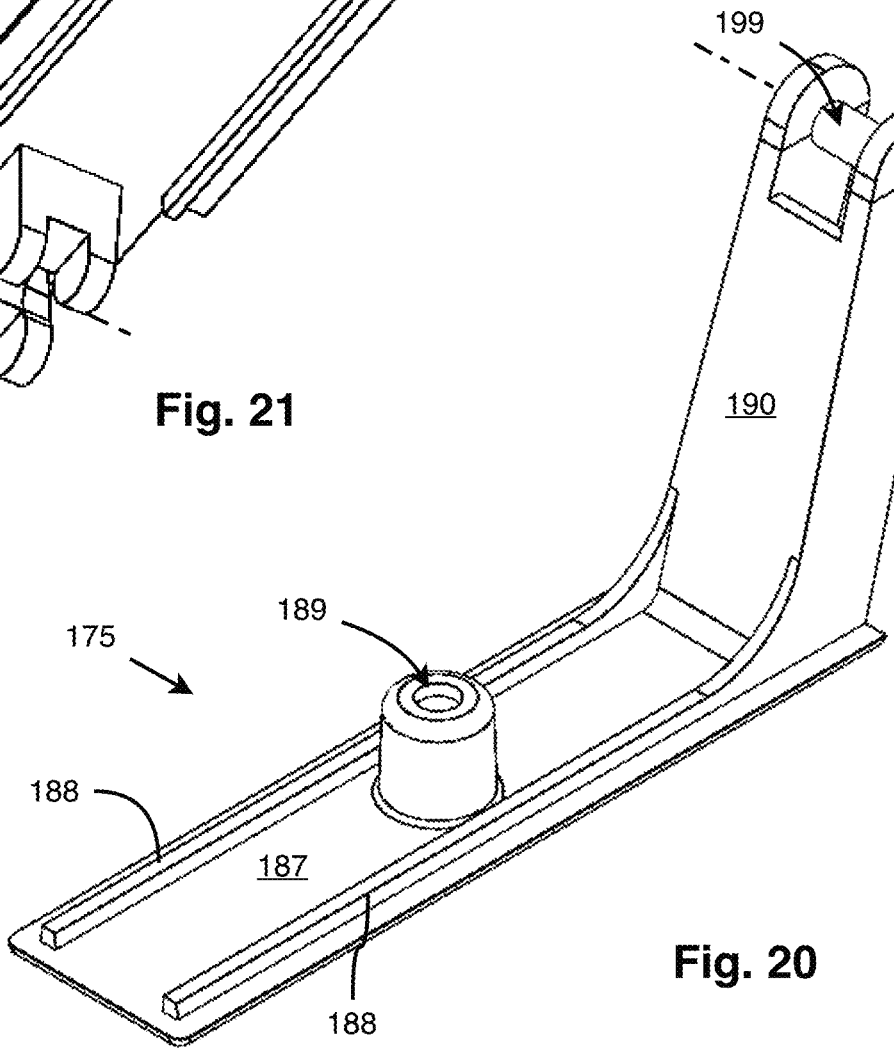
FIG. 20 is a perspective view of a bottom cap in accordance with an embodiment.
Figure 22:
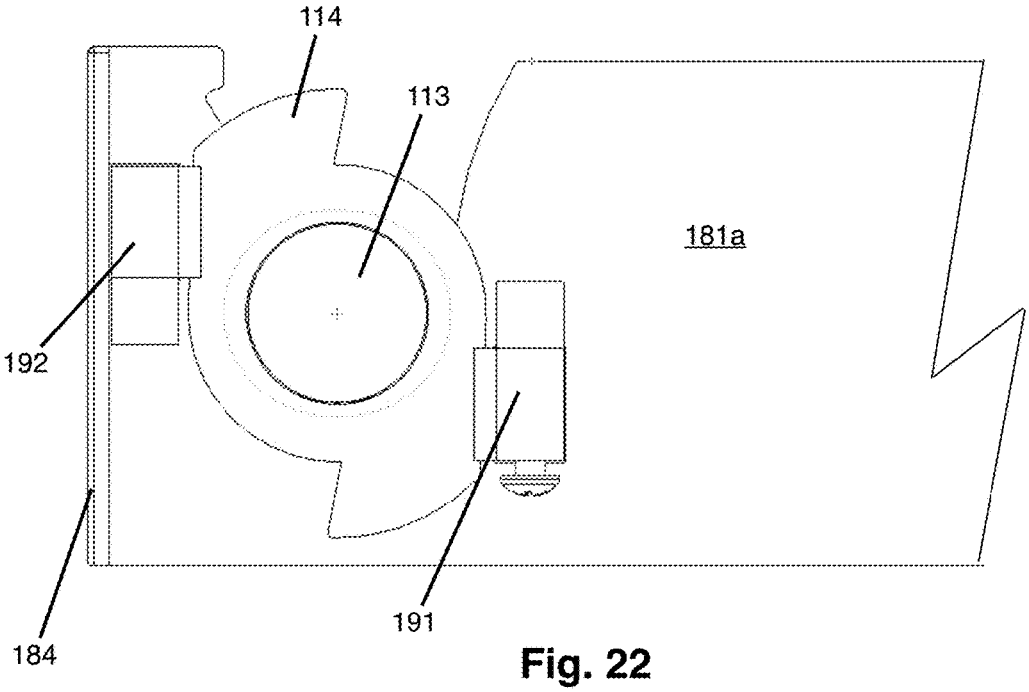
FIG. 22 is a side view a front portion of a support arm with a pivoting element mounted thereto and a distal side wall hidden in accordance with an embodiment.
Figure 23:
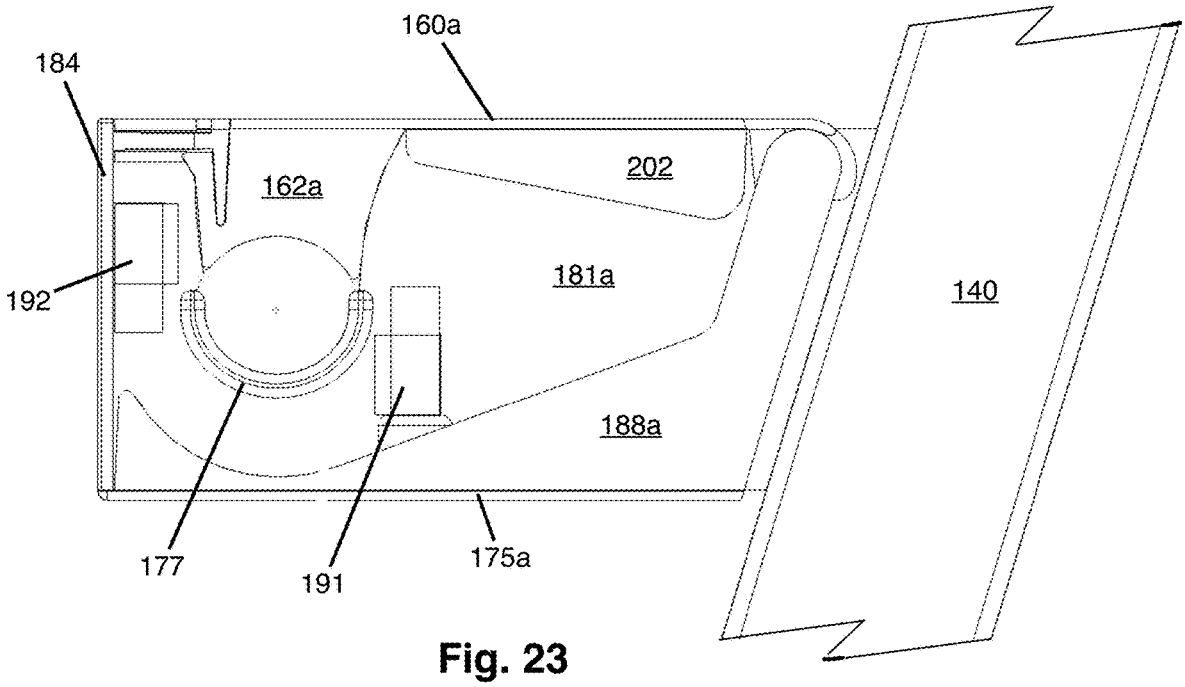
FIG. 23 is a side view of a support and of a portion of a side chair structure with no pivoting element mounted thereto and a distant side wall hidden in accordance with an embodiment.
Figure 24:
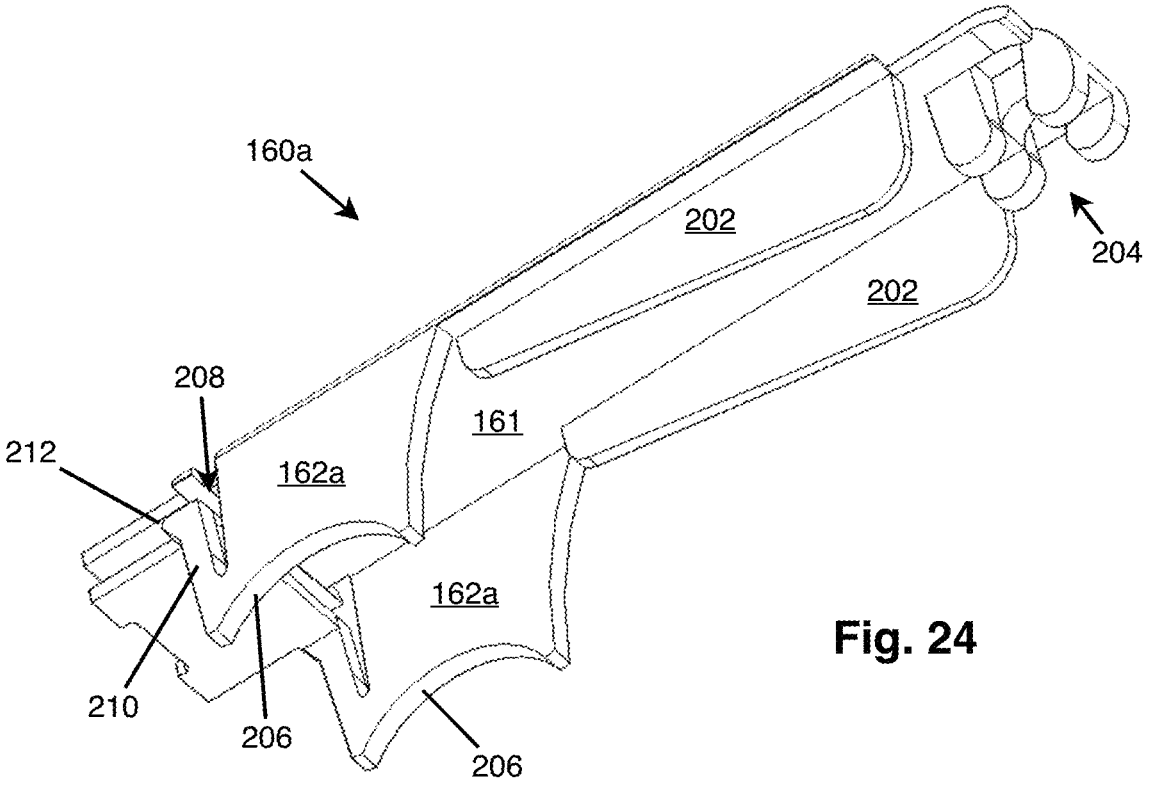
FIG. 24 is a perspective view of a hinged cap in accordance with the embodiment depicted on FIGS. 22 and 23.
Figure 25:
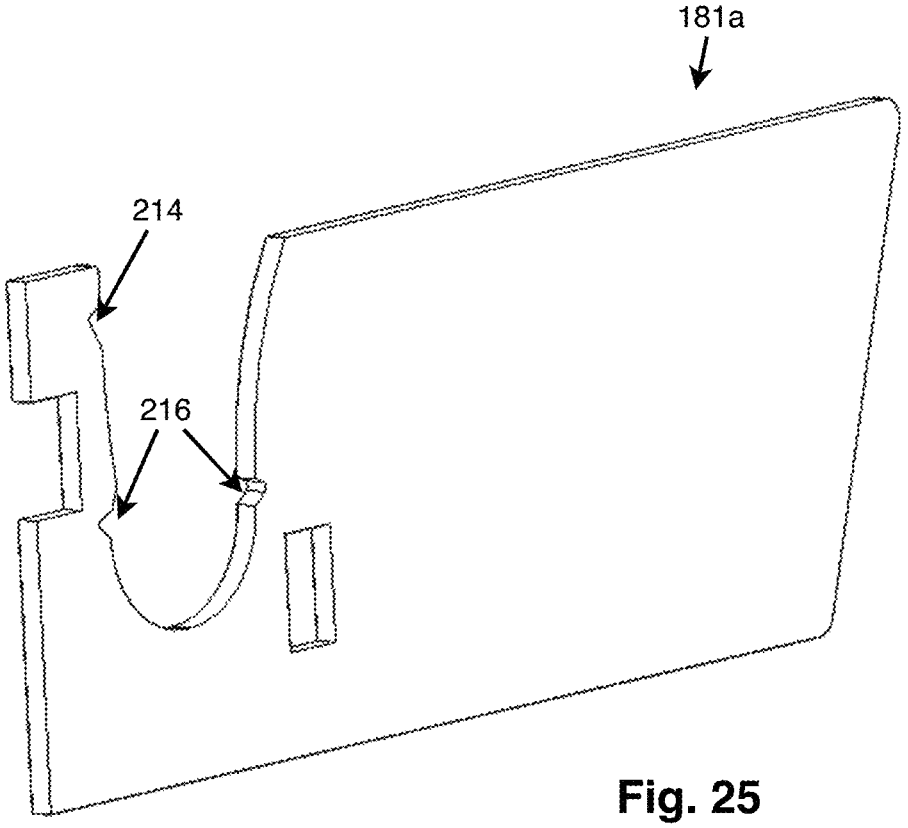
FIG. 25 is a perspective view of a side wall in accordance with the embodiment depicted on FIGS. 22 and 23.
Figure 26:
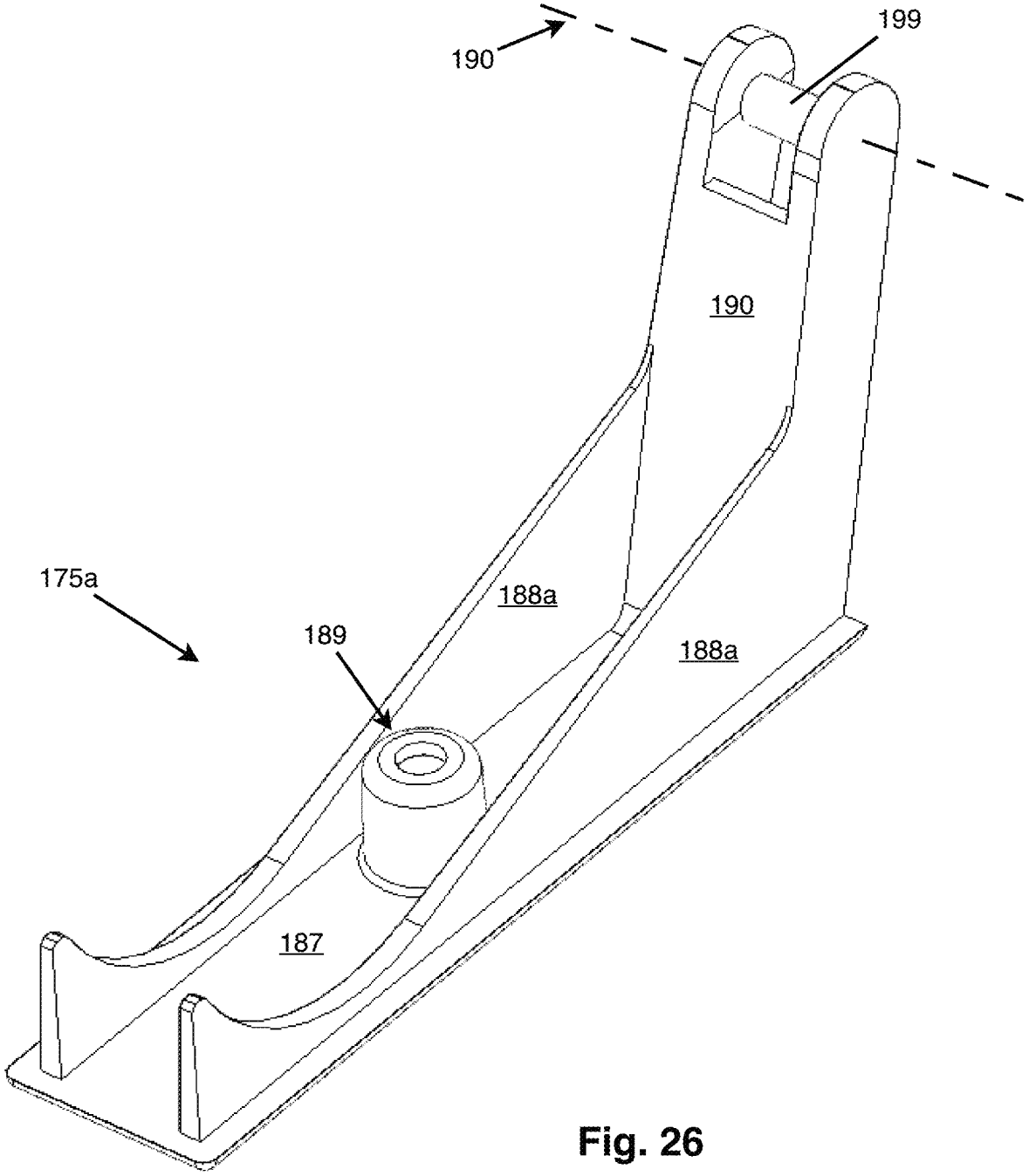
FIG. 26 is a perspective view of a bottom cap in accordance with the embodiment depicted on FIGS. 22 and 23.
Figure 27:
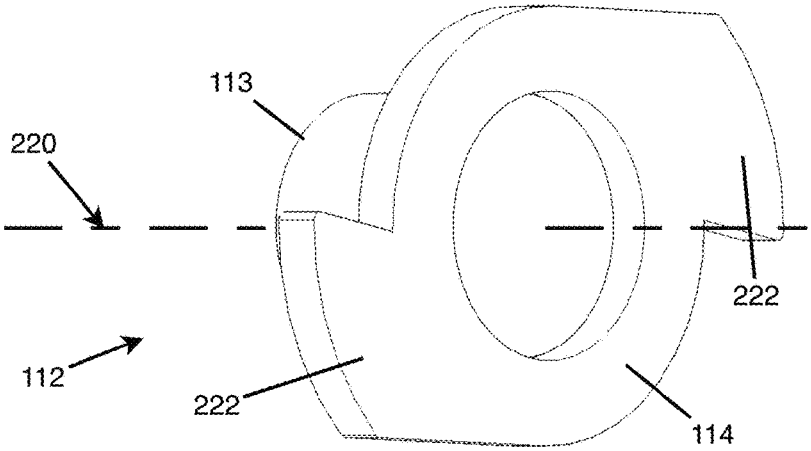
FIG. 27 is a perspective oblique front view of a mounting end of a pivoting element in accordance with an embodiment.
Figure 28:
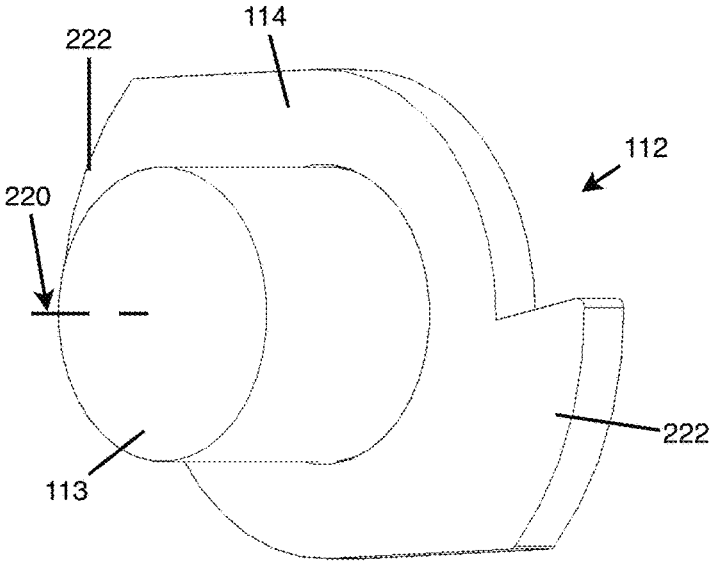
FIG. 28 is a perspective oblique rear view of the mounting end of FIG. 27.
Figure 29:
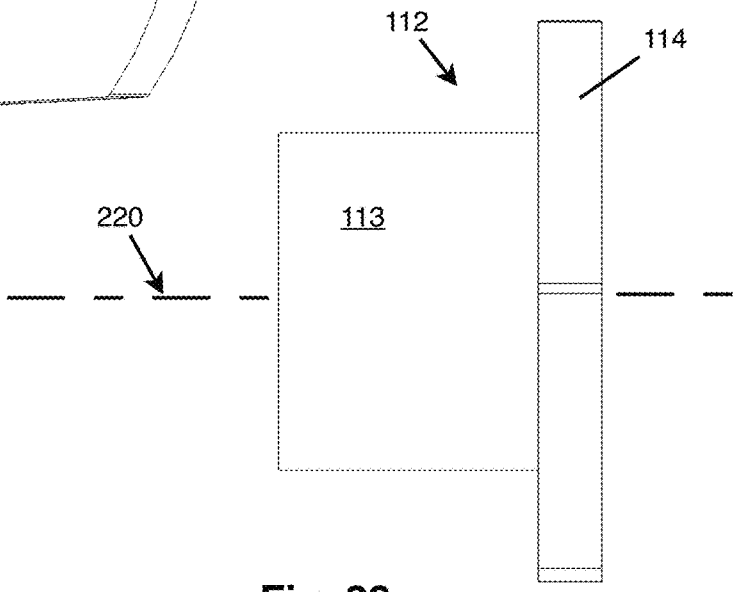
FIG. 29 is a side view of the mounting end of FIG. 27.

Referring additionally to FIG. 20, according to an embodiment, the bottom wall 183 is provided by a bottom cap 175 mountable to the proximal side wall 181 and the distal side wall 182 through its mounting to the abutting components 191. The bottom cap 175 is designed to occlude the bottom space between the side wall 181, 182. The bottom cap 175 comprises a wall 187 designed to occlude the bottom space, and lips 188 easing alignment of the bottom wall 183 to the side wall 181, 182. An opening 189 allows to screw the bottom cap 175 to the abutting components 191. The bottom cap 175 comprises a mast portion 190 extending upwardly that is designed to follow the side chair structure 140, and that is ending with an axle 199 designed for the hinged cap 160 to be pivotably mounted thereto.

According to an embodiment, the front piece 184 is a piece that is mounted to, e.g., welded to, the proximal side wall 181 and the distal side wall 182 before leaving the manufacturing plant. In an embodiment, the front piece 184 is welded to the side walls 181, 182 and to the abutting component 192. The front piece 184 is designed to occlude the front space between the side wall 181, 182.

Figure 21:
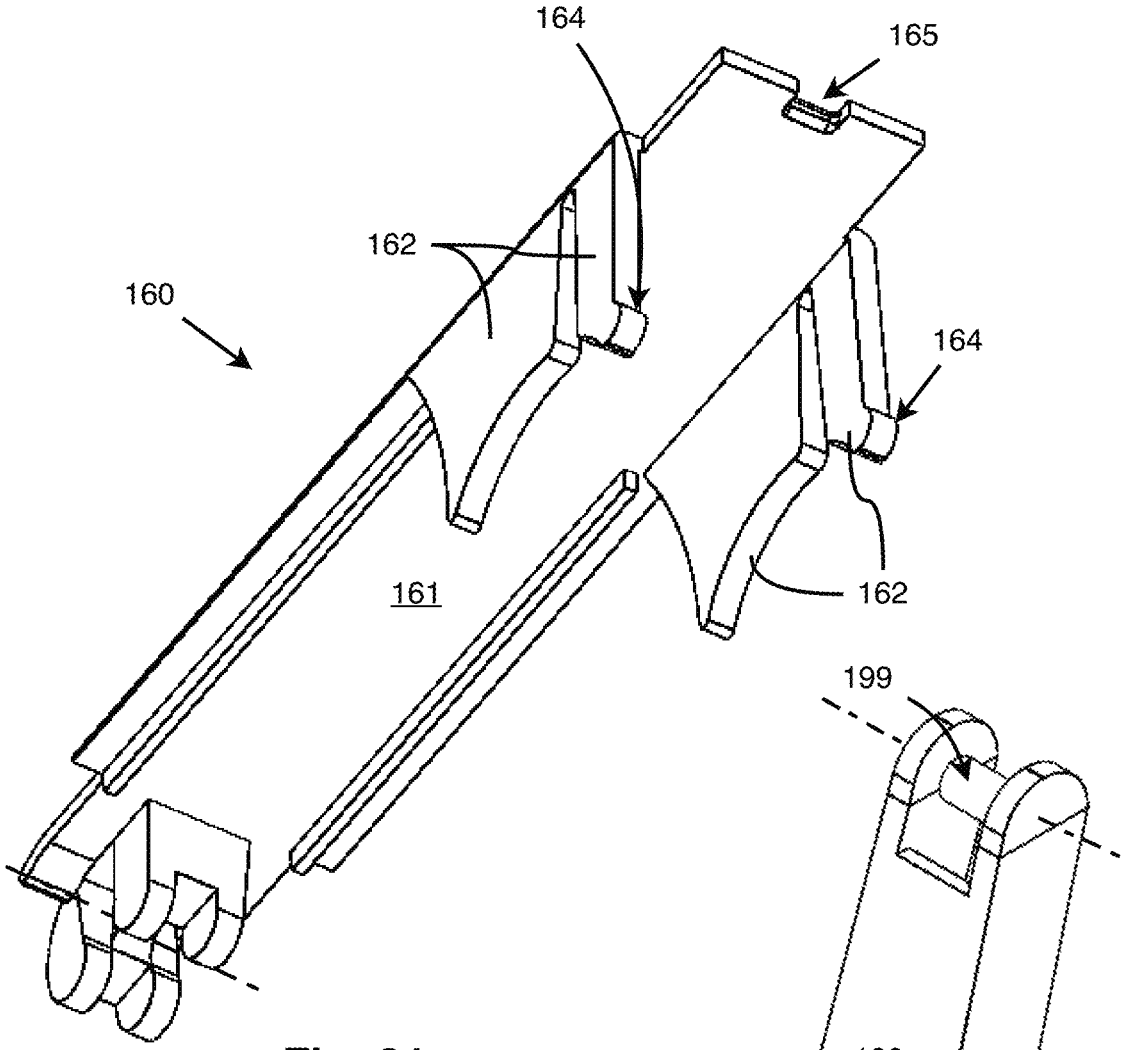
FIG. 21 is a perspective view of a hinged cap in accordance with an embodiment.

Referring additionally to FIG. 21, according to an embodiment a hinged cap 160 is mounted to the bottom cap 175 proximal to the side chair structure 140. The hinged cap 160 is shaped to close the opening 185 around the link arm 113 once the seat assembly 105 is mounted to the support arm 130. The hinged cap 160 comprises a top wall 161 designed to occlude the top space between the side faces 181, 182, and at least one wing 162 designed to occlude the side space left by the opening 185 above the link arm 113 once mounted. The hinged cap 160 comprises locking means 164 designed, once the hinged cap 160 is rotated from the elevated position, FIG. 4, in the occluding position, FIG. 5, to lock the hinged cap 160 in place. The hinged cap 160 comprises an indentation 165 providing an opening to pry the hinged cap 160 upward to release the hinged cap 160 from the occluding position. Thereby, the support arm 130 may be occluded on all sides, preventing a user to pinch their fingers anywhere in the mechanism or to reach the mechanism, and opened for maintenance, allowing to access the mechanism easily and rapidly for, e.g., changing components such any of the dampers 193, 194, or rapidly replacing the seat assembly 105 with a replacement seat assembly.

According to a preferred embodiment, the disk portion 118 of the cam component 114 has a greater diameter than the reminder of the opening 185 once the hinged cap 160 is rotated in the occluding position. Accordingly, the disk portion 118 prevents entry of any foreign material in the mechanism.

According to a preferred embodiment, the diameter of the disk portion 118 ensures that the cam component 114 remains in the interior side of the one extending most toward the interior of the support arm 130 among a) the proximal side wall 181, b) the sliding trim 177, and c) the at least one wing 162. Accordingly, the disk portion 118 keeps the cam component 114 inside the support arm 130, preventing the faces 115, 116 of the cam component 114 to pinch against non-leveled surfaces.

Referring additionally to FIGS. 13 to 16, according to a preferred embodiment, the thickness 119 of the cam component 114 is designed for the support arm 130 to hold two cam components 114 adapted to rotate side-by-side independently, wherein the link arms 113 to which are mounted the cam components 114 extend on opposite sides of the support arm 130.

Referring to FIGS. 22 to 26, an alternative embodiment differs from the above embodiment in design of the hinged cap, of the bottom can and of the side caps.

The alternative bottom cap 175*a* features lips 188*a* extending more upwards, offering an extended face to face side walls, e.g., side walls 181, 182, and improved structural support for the mast portion 190 of the bottom cap 175*a*.

The alternative hinged cap 160*a* features lips 202 that extend downward between a) a portion close to a grip portion 204 designed to take place on opposite sides of the axle 199 of the mast portion 190 and to allow the hinged cap 160*a* to rotate around the axle 199, and b) the wings 162*a*. The wings 162*a* differ from the wings 162 in the face 206 butting up against the link arm 113 being continuous with a slit 208 extending towards the face 206 without reaching it. On the front side of the slit 208 extends a segment 210 movable between a default position and a compressed position. A lug 212 extends at the extremity of the segment 210, that is designed to penetrate a recess 214 of the side plates, e.g., side plate 181*a* depicted on FIG. 25, when the hinged cap 160*a* is rotated into a position closing the support arm.

The alternative side plate 181*a* comprises a recess 214 designed to receive the lug 212 when the hinged cap 160*a* is rotated into the closed position, and recesses 216 designed to receive the sliding trims 177 onto the side plate 181*a*.

It is worth noting that the side-arm mechanism allowing installation, removal, maintenance and pivoting of pivoting seats between a seating position and an upright position remains substantially the same regardless of the embodiments of side arms. The hinged cap of the side arms can be opened in which position the seat can be mounted thereto with the link arms sitting on sliding trims mounted to side plates. The hinged cap are afterwards rotatable into a closing position enclosing the link arms into a confined location. When enclosed, the seat, including the link arms, can rotate between the upright position and the seating position, with the cam components abutting internal components and faces of the side arm setting limits of the sitting position and the upright position.

Referring to FIGS. 27 to 30, an exemplary mounting end 112 of a pivoting elements 110 comprises a link arm 113 of a revolution shape, e.g., cylindrical shape, defined around the pivot axis 220 extending therethrough. The cam component 114 is mounted, e.g., welded, glued, screwed, or mounted trough a spline mounting configuration, to the link arm 113. The cam component is extending substantially along a plane perpendicular to the pivot axis 220.

The cam component 114 comprises a pair of wings 222 each featuring two blocking faces 115, 116 designed to abut against a surface to limit rotation of the seat between the seating position and the upright position. The blocking face 116 is substantially tangent to a first circle 224 centered on the pivot axis 220, with the blocking face 116 being perpendicular to a first radius line 226. The blocking face 115 is substantially tangent to a second circle 228 centered on the pivot axis 220, with the blocking face 115 being perpendicular to a second radius line 230.

Figure 30:
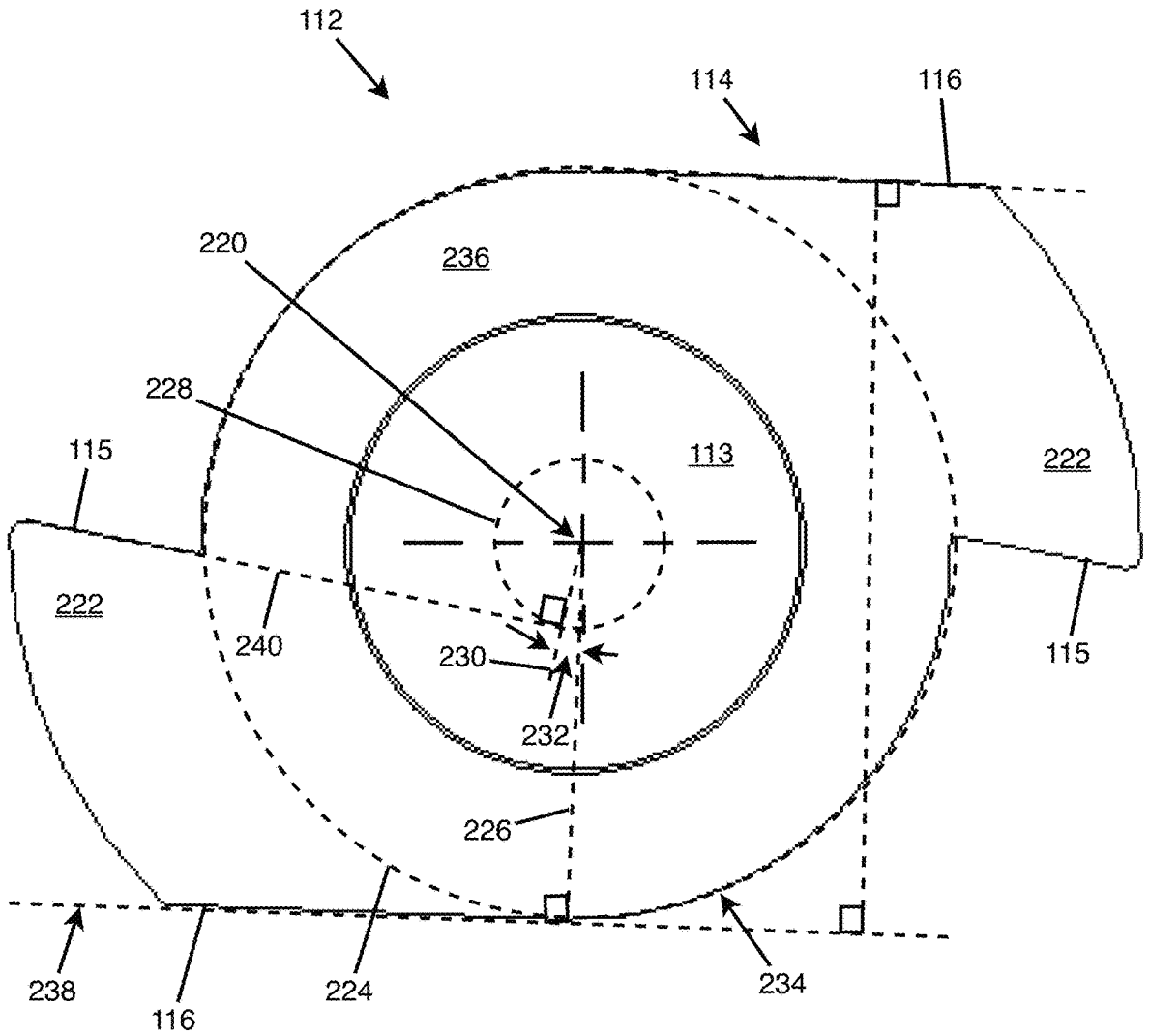
FIG. 30 is a front view of the mounting end of FIG. 27.

When analyzing FIG. 30, it is patent that the radius lines 226, 230 (extending from the pivot axis 220) have a span angle 232 of less that 90 degrees therebetween, resulting in e.g., the blocking face 116 being a continuation of the external face 234 of the general body 236 of the cam component 114, and the blocking face 115 providing a surface sloped relative to the blocking face 116, closer to the blocking face 116 where nearer to the pivot axis 220. It is further patent that the virtual planes 238, 240 of which the blocking faces 115, 116 are coplanar are extending on the same side of the pivot axis 220 rather than being distributed on opposite sides of a pivot axis 220 (which is the case with an arm extending clockwise and counterclockwise from a radius line extending from the pivot axis 220.

According to embodiments, the span angle 232 between the radius lines 226, 230 is smaller than 60 degrees, preferably smaller than 45 degrees, and preferably smaller than 30 degrees, and more preferably about or smaller than 20 degrees. Such configuration provides a compact and robust component.

According to embodiments, the circle 224 based on which the blocking face 116 is defined has a greater diameter than the circle 228 based on which the blocking face 115 is defined. Such structure participates once again in providing a compact and robust cam component 114.

According to embodiments, the ratio of diameters of the circle 224 over the smaller circle 228 is greater than 1.5 over 1, and preferably greater than 2 over 1, and more preferably about 3 over 1.

According to an embodiment, the circle 228 has a diameter smaller than the diameter of the link arm 113 where the link arm 113 coupled to the cam component 114. For its part, the circle 224 has a diameter greater than diameter of the link arm 113 where the link arm 113 is coupled to the cam component 114.

According to an embodiment, the blocking faces 115, 116 are flat, provided an extended energy-dissipating surface, further as decreasing costs of replacement of damping material.

It is worth noting than the configuration of the flat blocking face 116, of the block-shaped abutting component 191 (e.g., FIG. 12) extending from the bottom wall 183, and the general clearance on the side of the abutting component 191 opposite to the cam component 114 allow to install a pushing component, e.g., a biased pin, to push the blocking face 116 away from the abutting component 191 when no force is exerted on the seat. If such exemplary pin travels between a extended position and a compressed position, that pin would travel about parallel to the bottom wall 183.

Referring to FIGS. 1 to 16, according to an embodiment (not depicted), the support arm 130 features a dividing component, e.g., a wall, extending between at least a portion of two cam components 114 held in the same support arm 130, preventing rotation or lateral sliding of one seat 120 to be communicated to a neighbor seat.

According on an embodiment, the side chair structures 140 may be installed not exactly parallel to each other, e.g., a row of seats 120 may have a generally slightly an arc shape. The pivoting elements 110 allow, e.g., through use of a thick sliding trim 177, high angle tolerance. The pivot axis 151 can be not perpendicular to the proximal side wall 181 without hindering the operation of the mechanism as long as the cam component 114 does not pinch against the proximal side wall 181, the at least one wing 162, or the cam component 114 (when two cam components 114 are held in the same support arm 130. Furthermore, the edge 186 has an ellipse shape, with the semi-major axis of the ellipse extending substantially parallel to the horizontal. Such shape allows to place the chairs 100 in arched shape having a radius of e.g., at least 20 feet.

According to an embodiment, the seat assembly 105 may be manufactured, ready to install before leaving the manufacturing plant. The support arm 130 may similarly be mounted, when leaving the manufacturing plant, to comprise the bottom wall 183, the front piece 184, the sliding trims 177, and the hinged cap 160. Therefore, the assembly of the chair 100 may be limited to minimum steps and efforts on location.

According to an embodiment, the bottom wall 183 and the hinged cap 160 are made in plastic or polymer material. According to an embodiment, the sliding trim 177 is made of the same material.

Installation of a chairs 100, for instance having neighbor chairs on each side, according to an embodiment, follows these steps:

Step 1: side chair structures 140 are mounted to the floor, with a back seat 103 mounted to neighbor chair structures.

Figure 10:
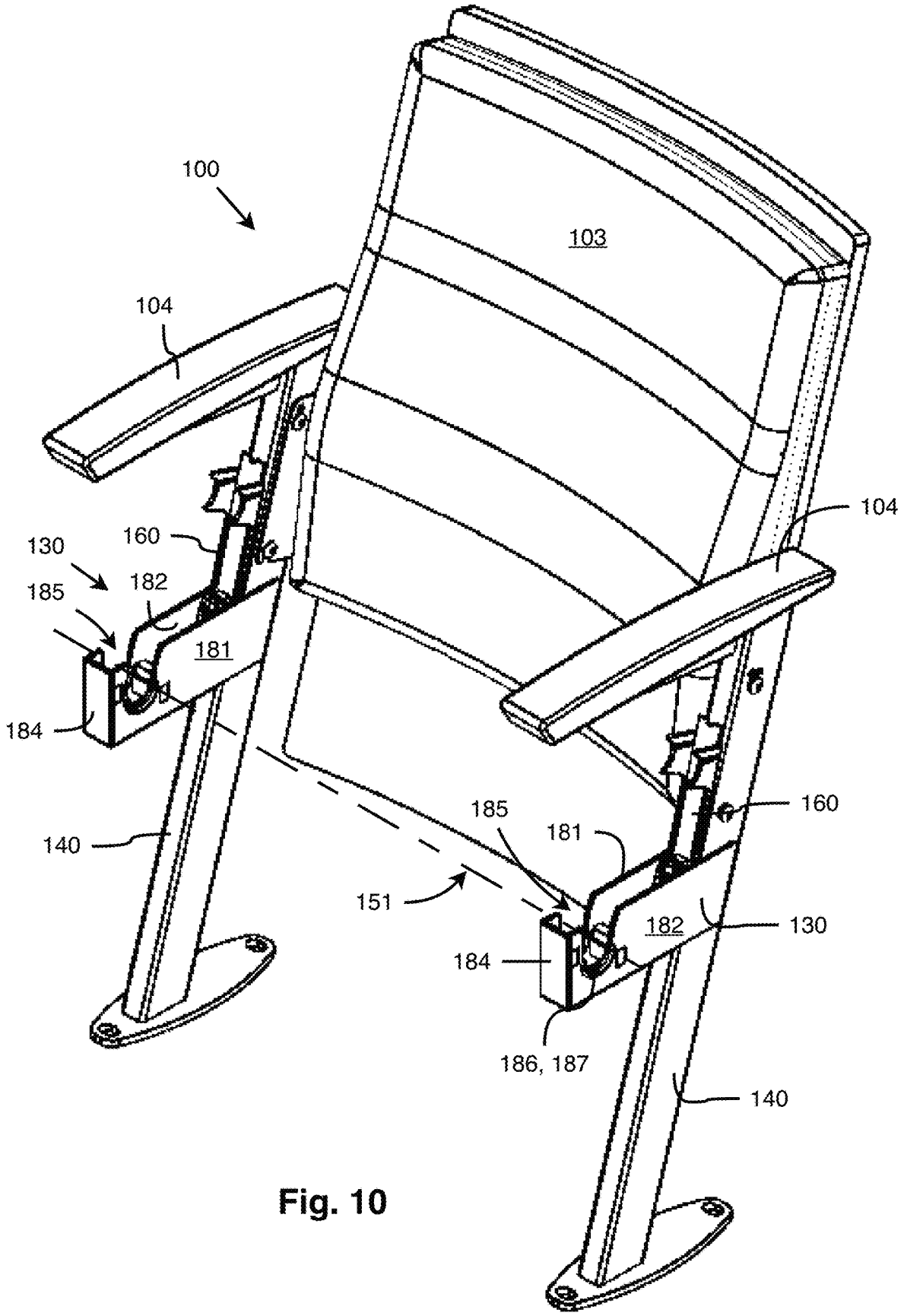
FIG. 10 is a perspective view of the chair prior to the installation of a seat, with the hinged caps in the elevated position in accordance with an embodiment.
Figure 11:
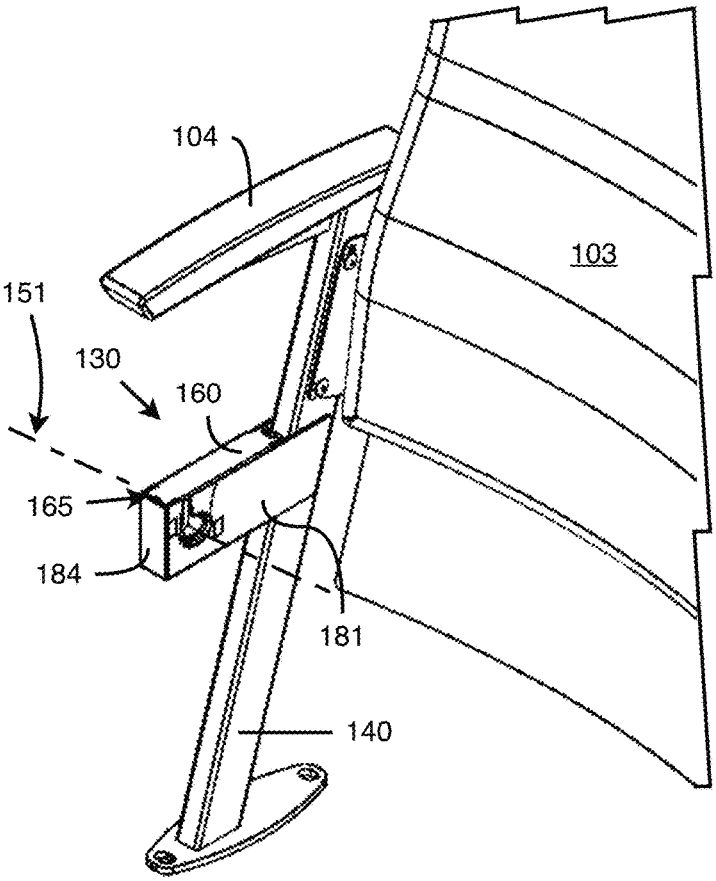
FIG. 11 is a perspective view of a right side portion of a portion of the chair of FIG. 1 prior to in the installation of a seat with the hinged caps in the occluding position.
Figure 12:
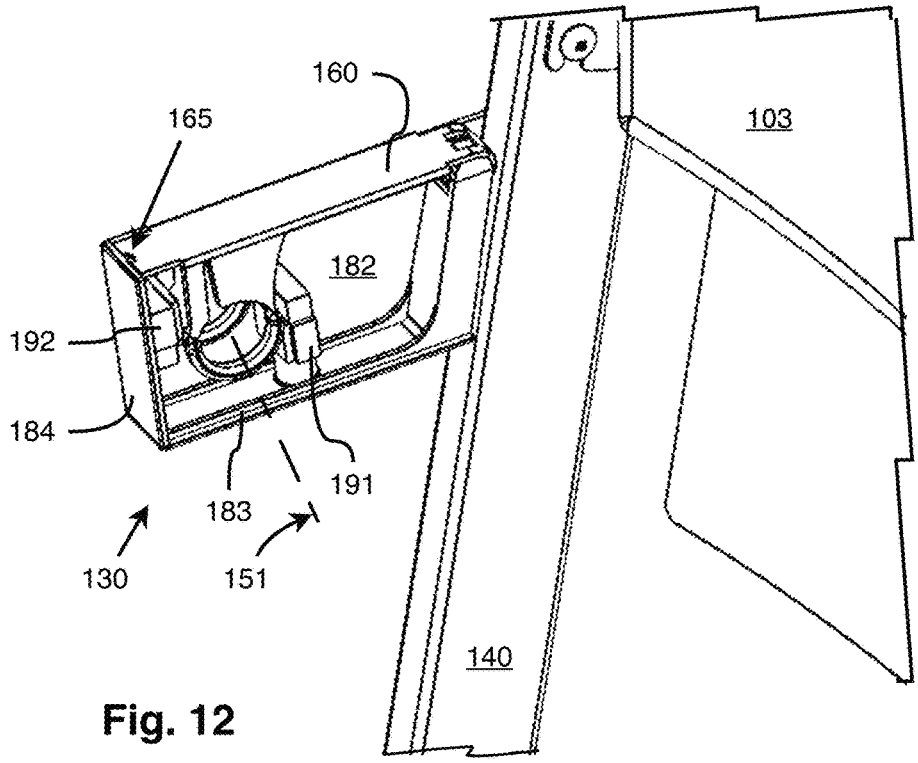
FIG. 12 is a more detailed perspective view of a right side portion of a portion the chair of FIG. 1 prior to in the installation of a seat with the hinged caps in the occluding position.
Figure 15:
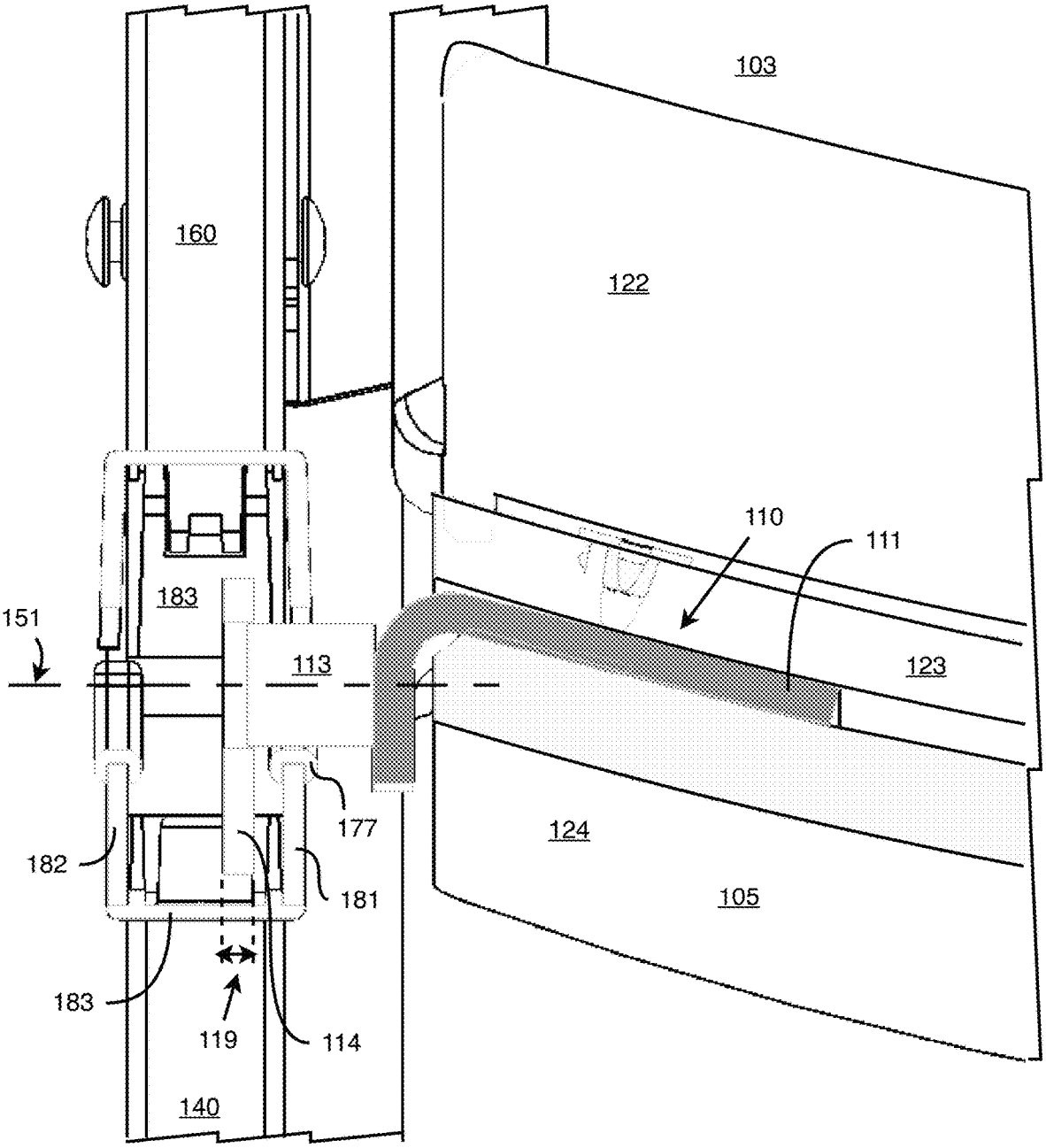
FIG. 15 is a cross-section front view of a right portion of the chair of FIG. 1 according to cross-section line 15-15 of FIG. 2, with the seat in the seating position.
Figure 16:
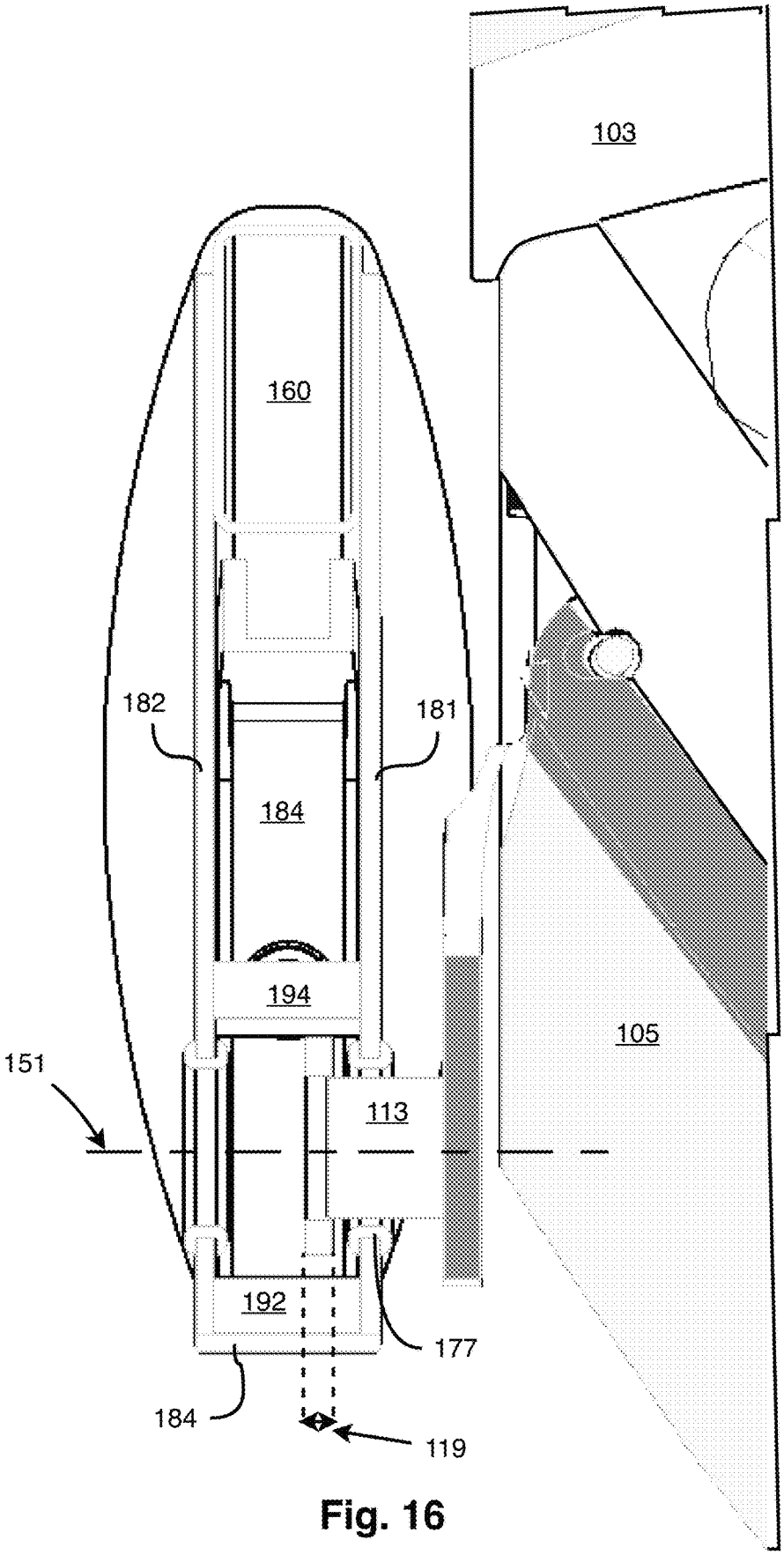
FIG. 16 is a cross-section plan view of a right portion of the chair of FIG. 1 according to cross-section line 16-16 of FIG. 3, with the seat in the seating position.

Step 2: the hinged cap 160 of the support arms 130 mounted to the side chair structures 140 are moved in the elevated position, result depicted in FIG. 10.

Step 3: the seat assembly 105 is lowered with the cam component 114 inserted between the side walls 181, 182 until the link arms 113 are resting on the sliding trim 177, result depicted on FIG. 4.

Step 4: the hinged caps 160 are closed, occluding any opening to the mechanism, result depicted on FIG. 5.

Optional steps may include, regardless of order, to mount armrests 104 to the side chair structures 140, and to adjust weights 128 if necessary. They may include to a mount side panel to a side chair structure 140, and/or to occlude an opening 185 with a circular cap (not shown) when the distal side wall 182 features an opening 185 and that no neighbor seat are designed to be installed on that side. They may include to mount signage to the back seat 103, the front of the seat assembly 105 and/or a side chair structure 140 or a side panel based on operating requirements.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. An assembly for mounting a seat to a chair structure, the assembly comprising:

support arms for mounting the seat thereto, each one of the support arms comprising a cap movable between an opened position and a closing position for selectively closing the support arm thereby having the support arm forming an enclosure;

a pair of pivoting assemblies mounted to the seat and extending along a pivot axis on opposite sides of the seat, each one of the pivoting assemblies comprising a) a link arm, and b) a cam component coupled to the link arm distant from the seat, wherein the cam component is adapted to rotate around the pivot axis along with the seat, with the cam component having its rotation being limited in both directions by abutting against at least one end-of-course surface, wherein, when the caps are in the opened position, each one of the support arms features a path for inserting the cam component into the enclosure, wherein, when the caps are in the closing position, the cam components are locked into the enclosure with the link arms extending between the seat and the enclosure, and wherein the cam component comprises a first pair of abutting faces extending tangentially to a first circle of a first diameter centered on the pivot axis, and a second pair of abutting faces extending tangentially to a second circle of a second diameter centered on the pivot axis, wherein the first diameter is smaller than the second diameter.

2. The assembly of claim 1, wherein the cam component comprises a wing comprising a) a first abutting face substantially tangent to a first circle centered on the pivot axis, with the first abutting face being perpendicular to a first radius line; and b) a second abutting face substantially tangent to a second circle centered on the pivot axis, with the second abutting face being perpendicular to a second radius line, wherein an angle smaller than 90 degrees spans between the first radius line and the second radius line.

3. The assembly of claim 2, wherein the assembly features a ratio of a diameter of the first circle over the diameter of the second circle of at least 1.5 over 1.

4. The assembly of claim 2, wherein the assembly features a spanning angle between a first radius line perpendicular to the first abutting face and a second radius line perpendicular to the second abutting face of less than 90 degrees, wherein the first radius line and the second radius line extend from the pivot axis.

5. The assembly of claim 2, wherein the first circle has a first diameter smaller than the link arm where coupled to the cam component.

6. The assembly of claim 2, wherein the second circle has a first diameter greater than the link arm where coupled to the cam component.

7. The assembly of claim 1, wherein the at least one end-of-course surface is located in the enclosure distant from the cap.

8. The assembly of claim 1, wherein the cam component provides flat abutting faces, and wherein the at least one end-of-course surface is flat, and wherein the abutting faces are designed to abut over a substantial portion of its surface against the at least one end-of-course surface.

9. The assembly of claim 1, further comprising blocks having at least one face providing an end-of-course surface.

10. The assembly of claim 9, wherein the blocks comprise compressible material able to damper movement of the cam component when abutting the block.

11. The assembly of claim 9, wherein the blocks being designed to be abutted about simultaneously by abutting faces of the cam component located on opposed wings, the blocks providing distributed couple over the cam component.

12. The assembly of claim 9, wherein the block comprises a first face designed for the cam component to abut against, and a second face opposed to the first face, wherein clearance of a length at least equivalent to space between the first face and the second face is present aside the second face.

13. The assembly of claim 1, wherein the support arms comprises a trim removably mounted to a side plate part of the support arm.

14. The assembly of claim 1, wherein the support arm further comprises a side plate featuring a recess designed for a lug located in the cap to be inserted in the recess to lock the cap into the closing position.

15. The assembly of claim 1, wherein the cam component comprises a pair of abutting faces extending parallel to each other parallel and equidistant to a plane coplanar with the pivot axis.

16. The assembly of claim 1, wherein the cam component is non-rotatably secured to the link arm.

17. An assembly for mounting a seat to a chair structure, the assembly comprising:

support arms for mounting the seat thereto, each one of the support arms comprising a cap movable between an opened position and a closing position for selectively closing the support arm into an enclosure;

a pair of pivoting assemblies mounted to the seat and extending along a pivot axis on opposite sides of the seat, each one of the pivoting assemblies comprising a) a link arm, and b) a cam component coupled to the link arm distant from the seat, wherein the cam component is adapted to rotate around the pivot axis along with the seat, with the cam component having its rotation being limited in both directions by abutting against at least one end-of-course surface, wherein when the caps are in the opened position, each one of the support arms features a path for inserting the cam component into the enclosure, wherein the support arm further comprises a pair of side plates, wherein the enclosure is designed to simultaneously receive a first cam component of the seat and a second cam assembly of another seat each coupled to respective link arm, with the respective link arms extending in opposed direction between a) the enclosure and the seat, and b) the enclosure and the other seat.

18. A chair comprising a chair structure comprising a pair of enclosures, a seat and an assembly for mounting the seat to the chair structure, the assembly comprising:

support arms for mounting the seat thereto, each one of the support arms comprising a cap movable between an opened position and a closing position for selectively closing the support arm thereby having each one of the support arms forming one of the enclosures;

a pair of pivoting assemblies mounted to the seat and extending along a pivot axis on opposite sides of the seat, each one of the pivoting assemblies comprising a) a link arm, and b) a cam component coupled to the link arm distant from the seat, wherein the cam component is adapted to rotate around the pivot axis along with the seat, with the cam component having its rotation being limited in both directions by abutting against at least one end-of-course surface, wherein, when the caps are in the opened position, each one of the support arms features a path for inserting the cam component into the enclosure, wherein, when the caps are in the closing position, the cam components are locked into the enclosure with the link arms extending between the seat and the enclosure, and wherein the cam component comprises a first pair of abutting faces extending tangentially to a first circle of a first diameter centered on the pivot axis, and a second pair of abutting faces extending tangentially to a second circle of a second diameter centered on the pivot axis, wherein the first diameter is smaller than the second diameter.

* * * * *